US010499486B2

(12) United States Patent
Cha et al.

(10) Patent No.: US 10,499,486 B2
(45) Date of Patent: Dec. 3, 2019

(54) IN-LIQUID PLASMA DEVICES AND METHODS OF USE THEREOF

(71) Applicant: KING ABDULLAH UNIVERSITY OF SCIENCE AND TECHNOLOGY, Thuwal (SA)

(72) Inventors: Min Suk Cha, Thuwal (SA); Ahmad Bassam Hamdan, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 16/072,709

(22) PCT Filed: Feb. 3, 2017

(86) PCT No.: PCT/IB2017/000202

§ 371 (c)(1),
(2) Date: Jul. 25, 2018

(87) PCT Pub. No.: WO2017/134531

PCT Pub. Date: Aug. 10, 2017

(65) Prior Publication Data

US 2019/0037679 A1 Jan. 31, 2019

Related U.S. Application Data

(60) Provisional application No. 62/290,626, filed on Feb. 3, 2016.

(51) Int. Cl.
*H05H 1/48* (2006.01)

(52) U.S. Cl.
CPC ..... *H05H 1/48* (2013.01); *H05H 2001/481* (2013.01); *H05H 2001/483* (2013.01); *H05H 2001/486* (2013.01)

(58) Field of Classification Search
None
See application file for complete search history.

(56) References Cited

U.S. PATENT DOCUMENTS 8,257,455 B2 * 9/2012 Lee ..... F01N 3/023 55/282.3
8,272,206 B2 * 9/2012 Lee ..... F01N 3/025 422/186.04

(Continued)

FOREIGN PATENT DOCUMENTS

WO 2012126095 A1 9/2012
WO 2015128738 A2 9/2015

OTHER PUBLICATIONS

Zhuo, R., et al.; "Silicon oxycarbide glasses for blood-contact applications"; Acta Biomaterialia vol. 1, Issue 5, Sep. 2005, pp. 583-589.

(Continued)

*Primary Examiner* — Dion Ferguson
*Assistant Examiner* — Srinivas Sathiraju
(74) *Attorney, Agent, or Firm* — Patent Portfolio Builders PLLC

(57) ABSTRACT

Devices and methods for generating a plasma in a liquid are provided. A low-dielectric material can be placed in contact with the liquid to form an interface a distance from an anode. A voltage can be applied across the anode and a cathode submerged in the liquid to produce the plasma. A variety of devices are provided, including for continuous operation. The devices and methods can be used to generate a plasma in a variety of liquids, for example for water treatment, hydrocarbon reformation, or synthesis of nanomaterial.

20 Claims, 30 Drawing Sheets

(56) References Cited

U.S. PATENT DOCUMENTS

| | | | | |
|---|---|---|---|---|
| 8,524,162 | B2 * | 9/2013 | Lee | B01D 53/32 204/168 |
| 8,568,662 | B2 * | 10/2013 | Lee | B01D 53/32 204/168 |
| 8,574,504 | B2 * | 11/2013 | Kim | B01D 53/32 422/186 |
| 8,640,541 | B2 * | 2/2014 | Abdel Aziz | B81B 3/0062 73/504.12 |
| 8,852,520 | B2 * | 10/2014 | Hur | H01J 37/32541 204/157.15 |
| 9,474,140 | B2 * | 10/2016 | Yinanc | H05H 1/2406 |
| 9,532,735 | B2 * | 1/2017 | Sana | A61B 5/05 |
| 9,600,238 | B2 * | 3/2017 | Radwan | G06F 7/58 |
| 9,606,093 | B2 * | 3/2017 | Alquaity | G01J 3/42 |
| 9,853,088 | B2 * | 12/2017 | He | H01L 45/1608 |
| 9,861,950 | B2 * | 1/2018 | Locke | C07C 29/48 |
| 9,867,151 | B2 * | 1/2018 | Bader | H04W 52/46 |
| 10,088,370 | B2 * | 10/2018 | Chrystie | G01J 5/0014 |
| 10,099,948 | B2 * | 10/2018 | Ghaffour | C02F 1/686 |
| 2007/0267289 | A1 * | 11/2007 | Jabs | B01J 19/088 204/170 |
| 2009/0109141 | A1 * | 4/2009 | Murase | B01J 19/088 345/71 |
| 2013/0039816 | A1 * | 2/2013 | Lee | B01D 53/32 422/170 |
| 2013/0320207 | A1 * | 12/2013 | Morokuma | H01J 49/0495 250/288 |
| 2014/0014496 | A1 * | 1/2014 | Yinanc | H05H 1/2406 204/168 |
| 2015/0244382 | A1 * | 8/2015 | Ishihara | H03L 7/26 331/94.1 |
| 2017/0034897 | A1 * | 2/2017 | Yinanc | H05H 1/2406 |
| 2017/0165629 | A1 * | 6/2017 | Cha | H05H 1/48 |
| 2018/0208464 | A1 * | 7/2018 | Cha | C01B 3/342 |
| 2018/0215616 | A1 * | 8/2018 | Cha | C01B 3/342 |
| 2019/0037679 | A1 * | 1/2019 | Cha | H05H 1/48 |

OTHER PUBLICATIONS

Aissaoui, N., et al.; "Silane Layers on Silicon Surfaces: Mechanism of Interaction, Stability, and Influence on Protein Adsorption"; Langmuir 28(1); Nov. 22, 2011; pp. 656-665.

Askari, S., et al.; "Crystalline Si nanoparticles below crystallization threshold: Effects of collisional heating in non-thermal atmospheric-pressure microplasmas"; Applied Physics, vol. 104; Apr. 2014; 6 pages.

Bashir, M., et al.; "Hydrophobic-Hydrophilic Character of Hexamethyldisiloxane Filmes Polymerized by Atmospheric Pressure Plasma Jet"; Plasma Chem Plasma Procss vol. 35, Issue 4; Jul. 2015; pp. 739-755.

Belmonte, T., et al.; "Interaction of discharges with electrode surfaces in dielectric liquids: application to nanoparticle synthesis"; Journal of Physics D: Applied Physics; May 14, 2014; 18 pages.

Bertóti, I., et al.; "XPS characterization of ultrafine Si3N4 powders"; Surface Interface Analysis, vol. 12; Jul. 1988; pp. 527-530.

Carriere, B., et al.; "X-Ray Photoelectron Study of Some Silicon-Oxygen Compounds"; Journal of Electron Spectroscopy and Related Phenomena, vol. 10, Issue 2, 1977, pp. 85-91 ((Month of Publication is unpublished. Per 37 CFR 1.98(b): The year of publication is sufficiently earlier than the effective U.S. filing date and any foreign priority date so that the particular month of publication is not in issue.).

Contarini, S., et al.; "XPS study on the dispersion of carbon additives in silicon carbide powders"; Applied Surface Science 51; Mar. 1991; pp. 177-183.

Das, G., et al.; "Microstructural Evolution of Termally Treated Low-Dielectric Constant SiOC:H Films Prepared by PECVD"; Journal of the Electrochemical Society 153(3); Feb. 2006; pp. F46-F51.

Das, G., et al.; "Vibrational spectroscopy characterization of low-dielectric constant SiOC:H films prepared by PECVD technique"; Materials Science in Semiconductor Processing, vol. 7, Issues 4-6, Nov. 11, 2004, pp. 295-300.

Du, P., et al.; "Effects of composition and thermal annealing on the mechanical properties of silicon oxycarbide films"; Sensors and Actuators, 176; Jan. 2012; pp. 90-98.

Fanelli, F., et al.; "Aerosol-Assisted Atmospheric Pressure Cold Plasma Deposition of Organic-Inorganic Nanocomposite Coatings"; Plasma Chem Plasma Process Dec. 2013; pp. 473-487.

Fauchais, R., et al.; "Parameters Controlling Liquid Plasma Spraying: Solutions, Sols, or Suspensions"; Journal of Thermal Spray Technology, vol. 17(1); Mar. 2008; pp. 31-59.

Gallis, S., et al.; "On the effects of thermal treatment on the composition, structure, morphology, and optical properties of hydrogenated amorphous silicon-oxycarbide"; J. Mater. Res., vol. 24, No. 8; Aug. 2008; pp. 2561-2503.

Gardner, S., et al.; "Surface Characterization of Carbon Fibers Using Angle-Resolved XPS and ISS"; Carbon, vol. 33, No. 5; 1995; pp. 587-595. (Month of Publication is unpublished. Per 37 CFR 1.98(b): The year of publication is sufficiently earlier than the effective U.S. filing date and any foreign priority date so that the particular month of publication is not in issue.).

Gates, S.M., et al.; "Preparation and structure of porous dielectrics by plasma enhanced chemical vapor deposition"; Journal of Applied Physics, vol. 101, Issue 9; May 2007; pp. 094103-1 to 094103-8.

Graham, W. G., et al.; "Plasmas in liquids and some of their applications in nanoscience"; Journal of Physics D: Applied Physics 44; Apr. 14, 2011; 8 pages.

Grill, A., et al.; Structure of low dielectric constant to extreme low dielectric constant SiCOH films: Fourier transform infrared spectroscopy characterization; Journal of Applied Physics, vol. 94, No. 10; Nov. 15, 2003; pp. 6697-6707.

Hamdan, A., et al.; "Comparison of Aluminum Nanostructures Created by Discharges in Various Dielectric Liquids"; Plasma Chem Plasma Process 34; Jun. 27, 2014; pp. 1101-1114.

Hamdan, A., et al.; "Dynamics of bubbles created by plasma in heptane for micro-gap conditions"; J. Acoust. Soc. Am. 134 (2); Aug. 2013; pp. 991-1000.

Hamdan, A., et al.; "Low-dielectric layer increases nanosecond electric discharges in distilled water"; AIP Advances, vol. 6, Issue 10; Oct. 2016; 7 pages.

Hamdan, A., et al.; "Synthesis of platinum embedded in amorphous carbon by micro-gap discharge in heptane"; Materials Chemistry and Physics, vol. 142, Issue 1, Oct. 15, 2013, pp. 199-206.

Janiak, C.; "Metal Nanoparticle Synthesis in Ionic Liquids"; Ionic Liquids (ILs) in Organometallic Catalysis. Topics in Organometallic Chemistry, vol. 51. Jan. 2014; pp. 17-54.

Kabbara, H., et al.; "Synthesis of nanocrystals by discharges in liquid nitrogen from Si-SN sintered electrode"; Scientific Reports 5:17477; Dec. 1, 2015; 8 pages.

Kim, M.T. et al.; "Characterization of amorphous SiC:H films deposited from hexamethyldisilazane"; Thin Solid Films, vol. 303, Issues 1-2, Jul. 15, 1997, pp. 173-179.

Kim, Y.H. et al.; "Infrared spectroscopy study of low-dielectric-constant fluorine-incorporated and carbon-incorporated silicon oxide films"; Journal of Applied Physics, vol. 90, No. 7; Oct. 1, 2001; pp. 3367-3370.

Kruis, F., et al.; "Synthesis of Nanoparticles in the Gas Phase for Electronic, Optical and Magnetic Applications—Review"; J. Aerosol Science, vol. 29, No. 5/6; Jul. 1998; pp. 511-535.

Lascovich, J.C., et al.; "Evaluation of the sp2/sp3 ratio in amorphous carbon structure by XPS and XAES"; Applied Surface Science 47(1):Jan. 17-21, 1991; pp. 17-21.

Lee, S. H., et al.; "Preparation and characterization of thin films by plasma polymerization of hexamethyldisiloxane"; Thin Solid Films, vol. 325, Issues 1-2, Jul. 18, 1998, pp. 83-86.

Maex, K., et al.; "Low dielectric constant materials for microelectronics"; Journal of Applied Physics, vol. 93, No. 11; Jun. 1, 2003; 50 pages.

Mariotti, D., et al.; "Microplasmas for nanomaterials synthesis"; Journal of Physics D: Applied Physics, 43; Jul. 29, 2010; 21 pages.

(56) References Cited

OTHER PUBLICATIONS

Martensson, N., et al.; "Core-Level Line Shapes of Adsorbates: Effects of Electronic and Vibrational Excitations"; Journal of Electron Spectroscopy and Related Phenomena, vol. 52; 1990, pp. 1-46. (Month of Publication is unpublished. Per 37 CFR 1.98(b): The year of publication is sufficiently earlier than the effective U.S. filing date and any foreign priority date so that the particular month of publication is not in issue.).

Moncoffre N., et al.; "Temperature Influence During Nitrogen Implantation Into Steel"; Nuclear Instruments and Methods in Physics Research Section B: Beam Interactions with Materials and Atoms, vols. 7-8, Part 1, Mar. 1985, pp. 177-183.

Moysan, C., et al.; "Mechanical characterization of a polysiloxane-derived SiOC glass"; Science Direct, Journal for the European Ceramic Society 27; Mar. 2006; pp. 397-403.

Muntean, A., et al.; "Generation of copper, nickel, and CuNi alloy nanoparticles by spark discharge"; Journal of Nanoparticle Research, 18:229; Aug. 2016; 9 pages.

Nastasi, M., et al.; "Superior radiation tolerant materials: Amorphous silicon oxycarbide"; Journal of Nuclear Materials, 461; Mar. 2015; pp. 200-205.

Olsson, C.O.A..; "An AES and XPS Study of the High Alloy Austenitic Stainless Steel 254 SMO Tested in a Ferric Chloride Solution"; Corrosion Science, vol. 36, Issue No. 1; Jan. 1994, pp. 141-151.

Pai, P.G., et al.; "Infrared spectroscopic study of SiOx films produced by plasma enhanced chemical vapor deposition"; J. Vac. Sci. Technol. A4(3); May-Jun. 1986; 7 pages.

Park, S.Y., et al.; "Plasma Polymerization of Hexamethyldisilazane" Polymer Journal, vol. 22, No. 3; Mar. 15, 1990; pp. 242-249.

Richmonds, C., et al.; "Plasma-liquid electrochemistry: Rapid systhesis of colloidal metal nanoparticles by microplasma reduction of aqueous cations" ; Applied Physics Letters 93:13; Oct. 2008; 5 pages.

Romdhane, F. B., et al.; "In Situ Growth of Cellular Two-Dimensional Silicon Oxide on Metal Substrates"; ACS NANO, vol. 7, No. 6; May 21, 2013; pp. 5175-5180.

Rübel, H., et al.; "IR Spectroscopy and Structure of RF Magnetron Sputtered a-SiC:H Films 2"; physica status solidi (B), vol. 139, Issue 1; Jan. 1, 1987; pp. 131-143.

Sankaran, R. M., et al.; "Synthesis of Blue Luminescent Si Nanoparticles Using Atmospheric-Pressure Microdischarges"; Nano Lett., 2005, 5 (3), Feb. 4, 2005; pp. 537-541.

Sano, N.; "Formation of multi-shelled carbon nanoparticles by arc discharge in liquid benzene"; Materials Chemistry and Physics, vol. 88, Issues 2-3, Dec. 15, 2004, pp. 235-238.

Sato, S., et al.; "Synthesis of nanoparticles of silver and platinum by microwave-induced plasma in liquid"; Surface & Coatings Technology, vol. 206, Issue 5, Nov. 25, 2011, pp. 955-958.

Seong, H.K, et al. Optical and electrical transport properties in silicon carbide nanowires; Applied Physics Letters, vol. 85, No. 7; Aug. 16, 2004.

Soraru, G., et al.; "XPS characterization of gel-derived silicon oxycarbide glasses"; Materials Letters 27; May 1996; pp. 1-5.

Wong, K.W., et al.; "Field-emission characteristics of SiC nanowires prepared by chemical-vapor deposition"; Applied Physics Letters, vol. 75, No. 19; Nov. 8, 1999; 4 pages.

Yonezawa, T., et al.; "Preparation of Zinc Oxide Nanoparticles by Using Microwave-induced Plasma in Liquid"; Chem. Lett. 39; Jun. 19, 2010; pp. 783-785.

Zhang, X., et al.; "Novel SiOC nanocomposites for high-yield preparation of ultra-large-scale SiC nanowires"; Nanotechnology, vol. 21, No. 38; Aug. 26, 2010; 8 pages.

Zhou, W., et al.; "Simple approach β-Sic nanowires: Synthesis, optical, and electrical properties"; Applied Physics Letters 89; Dec. 2006; 4 pages.

International Search Report in related International Application No. PCT/IB2017/000202, dated Jun. 9, 2017.

Written Opinion of the International Searching Authority in related International Application No. PCT/IB2017/000202, dated Jun. 9, 2017.

* cited by examiner

| Frequency ($cm^{-1}$) | Assignment | References |
|---|---|---|
| 680–900 | $\nu$(Si–$(CH_3)_{1,2,3}$); stretching mode | [Lee 1998, Gates 2007] |
| 928 | $\nu_a$(Si–N–Si); stretching asymmetric mode | [Kim 1997] [Park 1990] |
| 1060 | $\nu_a$(Si–O–Si), $\nu_a$(Si–O–C); stretching asymmetric mode | [Bashir 2015] [Gates 2007] |
| 1179 | $\delta$(N–H) Bending mode | [Park 1990] |
| 1249 | $\delta_s(CH_3)$ in Si–$CH_3$; bending symmetric mode | [Lee 1998] [Bashir 2015] |
| 1402 | $\delta_a(CH_3)$; bending asymmetric mode | [Lee 1998] |
| 2896 | $\nu_s$(C–H) in $CH_3$; stretching symmetric mode | [Lee 1998] [Gates 2007] |
| 2954 | $\nu_a$(C–H) in $CH_3$; stretching asymmetric mode | [Lee 1998] [Gates 2007] |
| 3381 | $\nu$(N–H); stretching mode | [Park 1990] |

FIG. 10

| *T* = 20 °C | | Ref. | *T* = 50 °C | | Ref. |
|---|---|---|---|---|---|
| | | **C 1s** | | | |
| 284.4 eV | *am*-C | [Lascovich 1991] | 284. ev | *am*-C | [Lascovich 1991] |
| 285.3 eV | C in hydrocarbon | [Moncoffre 1985] | 285.9. ev | C=O | [Mårtensson 1990] |
| | | | 288.8 ev | C≡O | [Olsson 1994] |
| | | **Si 2p** | | | |
| 101.7 eV | $SiCO_3$ | [Sorarù 1996] | | | |
| 102.9 eV | SiO in SiC $SiO_2C_2$ | [Contarini 1991] [Sorarù 1996] | 102.9 eV | SiO in SiC $SiO_2C_2$ | [Contarini 1991] [Sorarù 1996] |
| 103.9 eV | $SiO_3C$ | [Sorarù 1996] | 103.9 eV | $SiO_3C$ | [Sorarù 1996] |
| | | **O 1s** | | | |
| 532.4 eV | Si-O-Si | [Bertoti 1988] | 532.4 eV | Si-O-Si | [Bertoti 1988] |
| 533.1 eV | C-OH | [Gardner 1995] | 532.8 eV | C-O-C | [Gardner 1995] |

FIG. 22

IN-LIQUID PLASMA DEVICES AND METHODS OF USE THEREOF

CROSS-REFERENCE TO RELATED APPLICATIONS

This application is a U.S. National Stage of International Application No. PCT/IB2017/000202, filed on Feb. 3, 2017, which claims the benefit of and priority to U.S. Provisional Application Ser. No. 62/290,626, having the title "IN-LIQUID PLASMA DEVICES AND METHODS OF USE THEREOF," filed on Feb. 3, 2016, the disclosures of which are incorporated herein by reference in their entirety.

TECHNICAL FIELD

The present disclosure generally relates to devices and methods for forming plasmas in a liquid.

BACKGROUND

Classical ways to treat liquids using plasmas are by i) generating a plasma in a gas medium which is in contact with the liquid, ii) generating a plasma in bubbled liquid or iii) electrical discharges directly into the liquid. This latter is the richest process in chemical (production of radicals) and physical phenomena (production of shock waves and cavitation), however is also not sufficiently efficient for many applications.

Accordingly, there is a need for improved devices and methods for generating a plasma directly in a liquid.

SUMMARY

Provided herein are improved devices and methods for generating a plasma in a liquid. In certain embodiments, this disclosure provides devices for generating a plasma in a liquid, the device having a container configured to hold the liquid; a low-dielectric material configured to form an interface with the liquid in the container; an anode having a first end configured to be submerged in the liquid when in the container, and a cathode configured to contact the liquid when in the container. In various embodiments, the cathode and the first end of the anode are separated by a distance of about 1.0 mm to 10.0 mm or about 2.0 mm to 3.0 mm. In a variety of embodiments, the anode and the low-dielectric material are configured such that the interface is separated from the first end of the anode by a distance of about 0.0 mm to 4.0 mm or about 0.2 mm to 1.0 mm.

A variety of low-dielectric materials can be used in the devices and methods of the disclosure. In various embodiments, the low-dielectric material has a dielectric constant of about 1 to 10. The low-dielectric material can be a solid, for example $Al_2O_3$, $BaF_2$, $CaF_2$, $SrF_2$, polyethylene, polyvinyl chloride, or teflon. The low-dielectric material can be one or more liquids, for example a silazane, n-heptane, cyclohexane, or toluene. The low-dielectric material can be a gas, for example argon, helium, oxygen, carbon dioxide, nitrogen, or air.

The devices for generating a plasma in a liquid can have a variety of arrangements and configurations. The container can be configured such that the liquid can pass through the container for continuous operation. The container can contain a metal wall and the cathode can be the metal wall. In various other embodiments, the cathode can be a metallic rod, a metallic wire, a metallic needle, a metallic plate, or a combination thereof. The device can be configured to have a plurality of the anodes and the cathodes, e.g., forming from about 2 to 10 or about 2 to 8 anode-cathode pairs.

The device can have a ground source electronically coupled to the cathode, and can have a high-voltage power supply coupled to the anode. The high-voltage power supply can be a pulsed power supply, e.g., with an amplitude of about 10 kV to 20 kV, a pulse width of about 5 ns to 1000 ns, and/or an operating frequency of about 1 Hz to 1000 Hz.

Methods of producing a plasma in a liquid are provided by contacting the liquid with a low-dielectric material at an interface; submerging an anode in the liquid; contacting a cathode to the liquid; and applying a voltage to the anode to produce the plasma in the liquid. In various embodiments, the first end of the anode can be separated from the interface by a distance of about 0.0 mm to 4.0 mm or about 0.2 mm to 1.0 mm. The methods can be performed using one or more of the devices provided.

The methods and devices for generating a plasma in a liquid can be used for a variety of applications. In various embodiments, the liquid is water and the method includes water treatment or remediation. In various other embodiments, the liquid contains a hydrocarbon and the method includes hydrocarbon reformation. In some embodiments, the liquid contains a precursor and the method includes nanomaterial synthesis.

In an embodiment, a method of nanomaterial synthesis is provided. The method can comprise providing a container, wherein the container is configured to hold a plurality of immiscible dielectric liquids, wherein the plurality of dielectric liquids comprises a first liquid and a second liquid, wherein the first liquid and the second liquid are immiscible forming an interface between the first liquid and the second liquid; and the container comprises one or more anode and cathode pairs, wherein the one or more anode and cathode pairs respectively are immersed in the plurality of immiscible dielectric liquids, an anode of a anode and cathode pair immersed on a side of the interface opposite the cathode, wherein the one or more anode and cathode pairs are in electric communication with a power source; generating a plasma at the interface to create an interface layer by applying a high voltage to the anode(s) of the one or more anode and cathode pairs with the power source for a first period of time; allowing the container to rest for a second period of time, during which an interface layer forms at the interface; isolating the interface layer from the container; and drying the interface layer at a temperature for a third period of time thereby forming the nanomaterial.

In any one or more aspects of the method of nanomaterial synthesis, the first liquid can be a hydrocarbon source, a silicon source, or both. For example, the hydrocarbon source can be one or more hydrocarbons (such as liquid hydrocarbons) as described and/or defined herein. The silicon source can be an organosilicon. The first liquid can be hexamethyldisilazane, n-heptane, toluene, cyclohexane, propane, n-butane, isobutane, n-hexane, n-octane, n-decane, n-tridecane, benzene, toluene, ethyl benzene, cyclohexane, gasoline, kerosene, lubricating oils, diesel oils, crude oils and/or mixtures thereof. The second liquid can be an oxygen source, a hydrogen source, or both. The second liquid can be water. The temperature can be about 500° C. or less. The anode of the one or more anode and cathode pairs can be a first distance of about 4 mm or less away from the interface. The anode and cathode of the one or more anode and cathode pairs can be a second distance of about 10 mm or less away from the cathode. The nanomaterials produced can be gel-like or dispersed onto a sheet.

Other systems, methods, features, and advantages of the present disclosure for devices and methods for generating a plasma in a liquid and nanomaterials synthesis will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 10 is a table showing FT-IR band assignments in terms of observed frequency and vibrational mode.

FIG. 22 is a table depicting detail of the XPS peaks obtained from embodiments as described herein by fitting the high-resolution spectra of C 1s, Si 2p, and O 1s.

DETAILED DESCRIPTION

Figure 1:
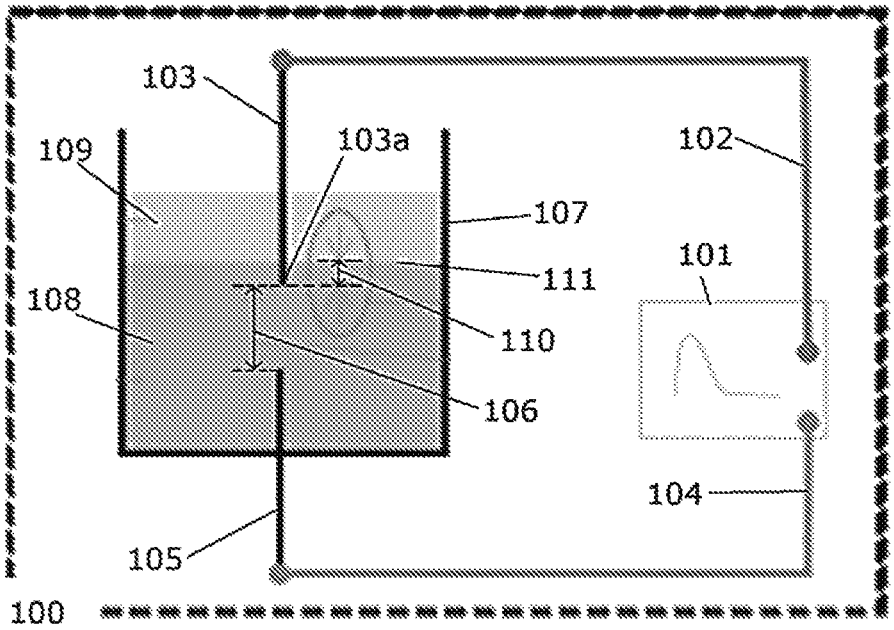
FIG. 1 is a diagram of one embodiment of an in-liquid plasma device.

This disclosure describes various methods and devices to increase the efficiency of the treatment of liquids by using in-liquid plasma. These devices and methods can be used for water treatment, liquid fuel reforming, and material synthesis. The device can include: a liquid container, two electrodes, and high-voltage power supply. The container is filled with liquid and the high-voltage is connected to the electrodes for providing high electric field to produce discharge in a gap between the electrodes.

Described below are various embodiments of devices and methods for in-liquid plasma generation that is for generating a plasma in a liquid. Although particular embodiments are described, those embodiments are mere exemplary implementations of the system and method. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications, and equivalents included within the spirit and scope of the disclosure.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

It is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Definitions

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

The terms "reformation" and "reforming", as used interchangeably herein, refer to the process of converting a hydrocarbon to methane, lower hydrocarbons, higher hydrocarbons, oxygenates, hydrogen gas, water, carbon dioxide, carbon monoxide, and combinations thereof. The process can include converting at least about 20 mol. %, 30 mol. %, 40 mol. %, 50 mol. %, 60 mol. %, 70 mol. %, 80 mol. %, 85 mol. %, 90 mol. %, 95 mol. %, 98 mol. %, or more of the hydrocarbon into methane, lower hydrocarbons, higher hydrocarbons, hydrogen gas, water, carbon dioxide, carbon monoxide, or a combination thereof. Reformation can convert hydrocarbons into a value added hydrocarbon mixture such as ethylene, naptha, gasoline, kerosene, or diesel oil.

The term "hydrocarbon", as used herein, refers generally to any saturated on unsaturated compound including at least carbon and hydrogen and, optionally, one or more additional atoms. Additional atoms can include oxygen, nitrogen, sulfur, or other heteroatoms. In some embodiments the hydrocarbon includes only carbon and hydrogen. The hydrocarbon can be a pure hydrocarbon, meaning the hydrocarbon is made of only carbon and hydrogen atoms. The term "hydrocarbon" includes saturated aliphatic groups (i.e., an alkane), including straight-chain alkanes, branched-chain alkanes, cycloalkanes, alkyl-substituted cycloalkanes, and cycloalkyl-substituted alkanes. In preferred embodiments, a straight chain or branched chain alkane has 30 or fewer carbon atoms in its backbone (e.g., $C_1$-$C_{30}$ for straight chains, and $C_3$-$C_{30}$ for branched chains), preferably 20 or fewer, more preferably 15 or fewer, most preferably 10 or fewer. Likewise, preferred cycloalkanes have 3-10 carbon atoms in their ring structure, and more preferably have 5, 6, or 7 carbons in the ring structure. The term "hydrocarbon" (or "lower hydrocarbon") as used throughout the specification, examples, and claims is intended to include both "unsubstituted alkanes" and "substituted alkanes", the latter of which refers to alkanes having one or more substituents replacing a hydrogen on one or more carbons of the hydrocarbon backbone. Such substituents include, but are not limited to, halogen, hydroxyl, carbonyl (such as a carboxyl, alkoxycarbonyl, formyl, or an acyl), thiocarbonyl (such as a thioester, a thioacetate, or a thioformate), alkoxyl, phosphoryl, phosphate, phosphonate, phosphinate, amino, amido, amidine, imine, cyano, nitro, azido, sulfhydryl, alkylthio, sulfate, sulfonate, sulfamoyl, sulfonamido, sulfonyl, heterocyclyl, aralkyl, or an aromatic or heteroaromatic moiety.

The term "lower hydrocarbon", as used herein, refers generally to a hydrocarbon having a lower overall number of carbon atoms or a lower overall molecular weight as compared to a reference hydrocarbon. Unless the number of carbons is otherwise specified, "lower hydrocarbon" as used herein includes "lower alkanes", "lower alkenes", and "lower alkynes" having from one to ten carbons, from one to six carbon atoms, or from one to four carbon atoms in its backbone structure. The lower hydrocarbon can include ethane, ethene, propane, and propene, heptane, octane, optionally including one or more substituents or heteroatoms, as well as derivatives thereof.

The term "higher hydrocarbon", as used herein, refers generally to a hydrocarbon having a higher overall number of carbon atoms or a higher overall molecular weight as compared to a reference hydrocarbon. Unless the number of carbons is otherwise specified, "high hydrocarbon" as used herein can include "higher alkanes", "higher alkenes", and "higher alkynes" having from two to twenty carbon atoms, four to twenty carbon atoms, four to eighteen carbon atoms, six to eighteen carbon atoms, or from ten to eighteen carbon atoms. Higher hydrocarbons can include alkanes and cycloalkanes having from five to twelve carbon atoms and commonly found in petrol. Higher hydrocarbons can include alkanes have more than twelve carbon atoms, e.g. from twelve to thirty or from twelve to twenty carbon atoms and commonly found in diesel oil.

The term "oxygenate", as used herein, refers to the corresponding hydrocarbon, lower hydrocarbon, or higher hydrocarbon wherein one or more hydrogen atoms has been substituted with an —OH substituent to form an alcohol.

The term "naptha", as used herein, refers to a mixture of hydrocarbons containing predominately hydrocarbons having from five to ten carbon atoms. Naptha can have a boiling temperature from 30° C. to 200° C., from 40° C. to 190° C., or from 50° C. to 180° C. Naptha can include "light naptha" or "heavy naptha". The term "light naptha" refers to mixtures of hydrocarbons containing predominately hydrocarbons have five or six carbon atoms and having a boiling point from 30° C. to 90° C. or from 30° to 80° C. The term "heavy naptha" refers to mixtures of hydrocarbons containing predominately hydrocarbons having from six to twelve, from seven to twelve, or from eight to ten carbon atoms and having a boiling point from 90° C. to 200° C., from 100° C. to 200° C., or from 120° C. to 180° C.

Suitable heteroatoms can include, but are not limited to, O, N, Si, P, Se, B, and S, wherein the phosphorous and sulfur atoms are optionally oxidized, and the nitrogen heteroatom is optionally quaternized. Heteroatoms such as nitrogen may have hydrogen substituents and/or any permissible substituents of organic compounds described herein which satisfy the valences of the heteroatoms. It is understood that "substitution" or "substituted" includes the implicit proviso that such substitution is in accordance with permitted valence of the substituted atom and the substituent, and that the substitution results in a stable compound, i.e. a compound that does not spontaneously undergo transformation such as by rearrangement, cyclization, elimination, etc.

The term "substituted" as used herein, refers to all permissible substituents of the compounds described herein. In the broadest sense, the permissible substituents include acyclic and cyclic, branched and unbranched, carbocyclic and heterocyclic, aromatic and nonaromatic substituents of organic compounds. Illustrative substituents include, but are not limited to, halogens, hydroxyl groups, or any other organic groupings containing any number of carbon atoms, preferably 1-14, 1-12, or 1-6 carbon atoms, and optionally include one or more heteroatoms such as oxygen, sulfur, or nitrogen grouping in linear, branched, or cyclic structural formats. Representative substituents include alkyl, substituted alkyl, alkenyl, substituted alkenyl, alkynyl, substituted alkynyl, phenyl, substituted phenyl, aryl, substituted aryl, heteroaryl, substituted heteroaryl, halo, hydroxyl, alkoxy, substituted alkoxy, phenoxy, substituted phenoxy, aroxy, substituted aroxy, alkylthio, substituted alkylthio, phenylthio, substituted phenylthio, arylthio, substituted arylthio, cyano, isocyano, substituted isocyano, carbonyl, substituted carbonyl, carboxyl, substituted carboxyl, amino, substituted amino, amido, substituted amido, sulfonyl, substituted sulfonyl, sulfonic acid, phosphoryl, substituted phosphoryl, phosphonyl, substituted phosphonyl, polyaryl, substituted polyaryl, C3-C20 cyclic, substituted C3-C20 cyclic, heterocyclic, substituted heterocyclic, aminoacid, peptide, and polypeptide groups.

In a broad aspect, the permissible substituents include acyclic and cyclic, branched and unbranched, carbocyclic and heterocyclic, aromatic and nonaromatic substituents of organic compounds. Illustrative substituents include, for example, those described herein. The permissible substituents can be one or more and the same or different for appropriate organic compounds. The heteroatoms such as nitrogen may have hydrogen substituents and/or any permissible substituents of organic compounds described herein which satisfy the valencies of the heteroatoms.

In various embodiments, the substituent is selected from alkoxy, aryloxy, alkyl, alkenyl, alkynyl, amide, amino, aryl, arylalkyl, carbamate, carboxy, cyano, cycloalkyl, ester, ether, formyl, halogen, haloalkyl, heteroaryl, heterocyclyl, hydroxyl, ketone, nitro, phosphate, sulfide, sulfinyl, sulfonyl, sulfonic acid, sulfonamide, and thioketone, each of which optionally is substituted with one or more suitable substituents. In some embodiments, the substituent is selected from alkoxy, aryloxy, alkyl, alkenyl, alkynyl, amide, amino, aryl, arylalkyl, carbamate, carboxy, cycloalkyl, ester, ether, formyl, haloalkyl, heteroaryl, heterocyclyl, ketone, phosphate, sulfide, sulfinyl, sulfonyl, sulfonic acid, sulfonamide, and thioketone, wherein each of the alkoxy, aryloxy, alkyl, alkenyl, alkynyl, amide, amino, aryl, arylalkyl, carbamate, carboxy, cycloalkyl, ester, ether, formyl, haloalkyl, heteroaryl, heterocyclyl, ketone, phosphate, sulfide, sulfinyl, sulfonyl, sulfonic acid, sulfonamide, and thioketone can be further substituted with one or more suitable substituents.

The term "high melting point", when referring to a metal or metal alloy herein, means a metal or metal alloy having a melting point that is about 800° C., 900° C., 1000° C., 1200° C., 1500° C., 2000° C., 2500° C. or higher.

Description

We now provide a description of various embodiments and aspects of the devices and methods for generating a plasma in a liquid and nanomaterials synthesis provided herein. In general, a low-dielectric material can be placed in contact with the liquid to form an interface a distance from an anode. A voltage can be applied across the anode and a cathode submerged in the liquid to produce the plasma. A variety of devices are provided, including for continuous operation. The devices and methods can be used to generate a plasma in a variety of liquids, for example for water treatment, hydrocarbon reformation, or synthesis of nanomaterials, as described in more detail below.

Devices for In-Liquid Plasma Generation

A variety of devices are provided for generating a plasma in a liquid. In various embodiments, the devices provide for efficient generation of high intensity plasmas in a variety of liquids. In some aspects, the device contains a container configured to hold the liquid; a low-dielectric material configured to form an interface with the liquid in the container; an anode having a first end configured to be submerged in the liquid when in the container; and a cathode configured to contact the liquid when in the container. The skilled artisan will recognize that a variety of container materials and container configurations may be suitably employed for the devices described herein. All such containers are intended to be covered by the disclosure. For example, in some embodiments the container can be configured such that the liquid can pass through the container for continuous operation. In some embodiments the container is or contains a metal wall and the cathode is the metal wall.

An exemplary device 100 for generating a plasma in a liquid is depicted in FIG. 1. A high-voltage power supply 101 is coupled via a lead 102 to an anode 103. The ground 104 is coupled to the cathode 105. The cathode 105 and the anode 103 are configured in the container 107 such that they are submerged in the liquid 108 when in the container 107. The liquid 108 can be water. A dielectric material 109, for example n-heptane, contacts the liquid 108 to form an interface 111. The interface 111 is separated from the end of the anode 103*a* by a distance 110, for example about 0.0 mm to 4.0 mm.

There is a gap or distance 106 between the cathode and the anode. The gap or distance can be between the cathode 105 and the end 103*a* of the anode. An electrical discharge across the gap can produce a plasma in the liquid. In various embodiments, the cathode and the end (a first end) of the anode are separated by a distance of about 1.0 mm to 10.0 mm, about 1.0 mm to 3.0 mm, or about 2.0 mm to 3.0 mm, or about 2.5 mm. The electrodes, the anode and the cathode, can be made from a variety of materials capable of withstanding the high voltages, e.g., that have a high melting point to withstand the high temperatures that can be generated. The electrodes can contain iron, copper, tungsten, gold, platinum, or alloys or combinations thereof.

Figure 2A:
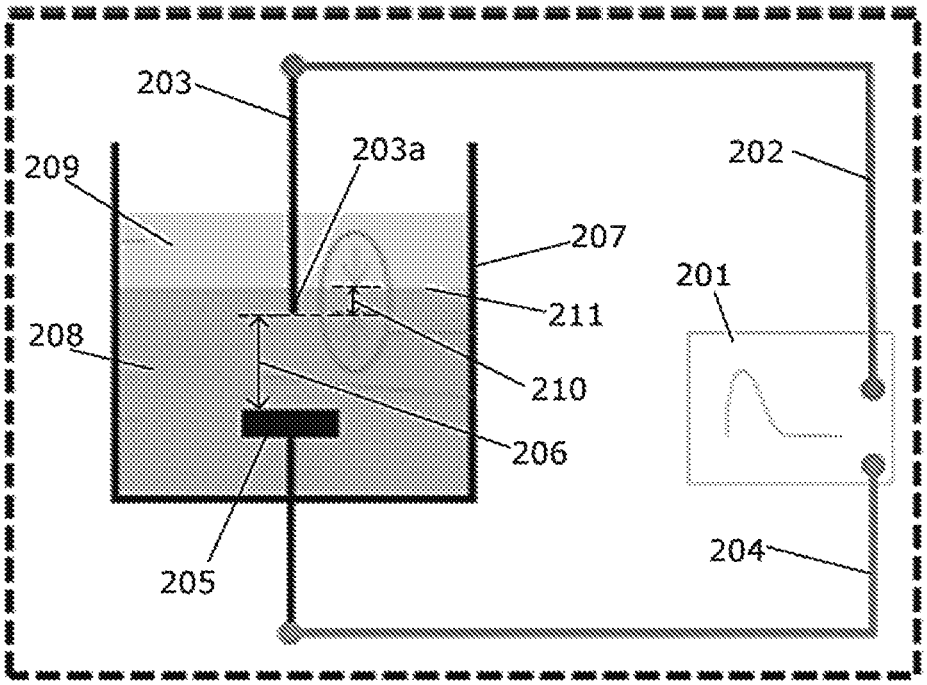
FIG. 2A is a diagram of one embodiment of an in-liquid plasma device containing a metallic plate cathode.

The anode and the cathode can be provided in a variety of configurations where (1) the anode is configured such that the end of the anode is submerged in the liquid when the liquid is in the container and (2) the cathode contacts and/or is submerged in the liquid when the liquid is in the container. The electrodes can have a variety of configurations designed to generate the high electrical discharge in the liquid. The electrodes can have a wire-like configuration, a plate-like configuration, a pin-like configuration, a rod-like configuration, a cylinder-like configuration, or a combination thereof. The pair of electrodes can be arranged in a wire to plate configuration, a plate to plate configuration, a pin to plate configuration, a pin to pin configuration, a pin to rod configuration, a rod to rod configuration, a wire to cylinder configuration, or a combination thereof. FIG. 2A depicts an embodiment where the cathode 205 is a metal plate.

Figure 2B:
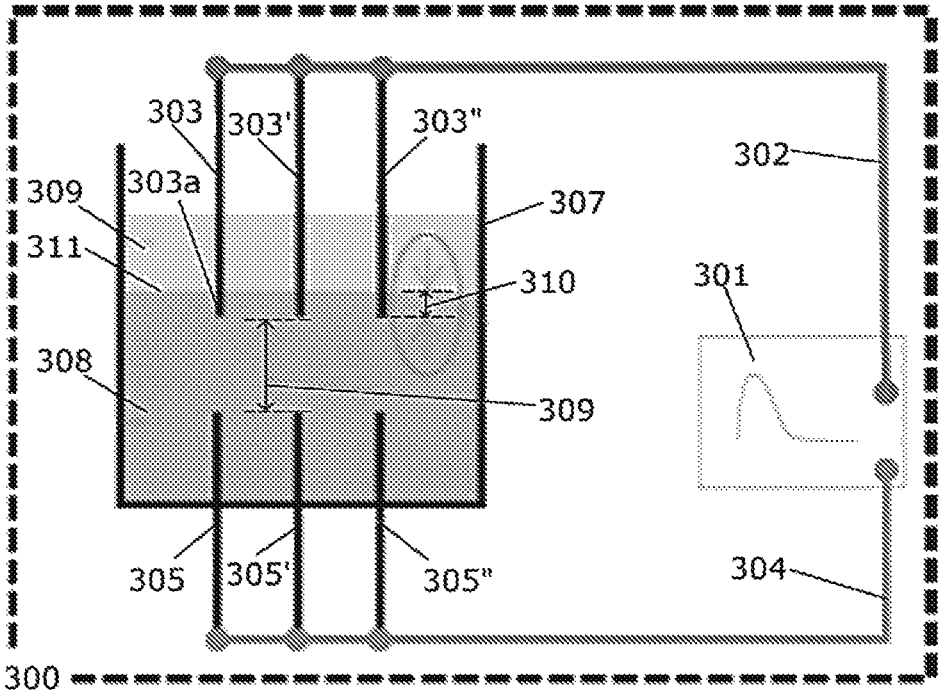
FIG. 2B is a diagram of one embodiment of an in-liquid plasma device containing multiple electrode pins.
Figure 2C:
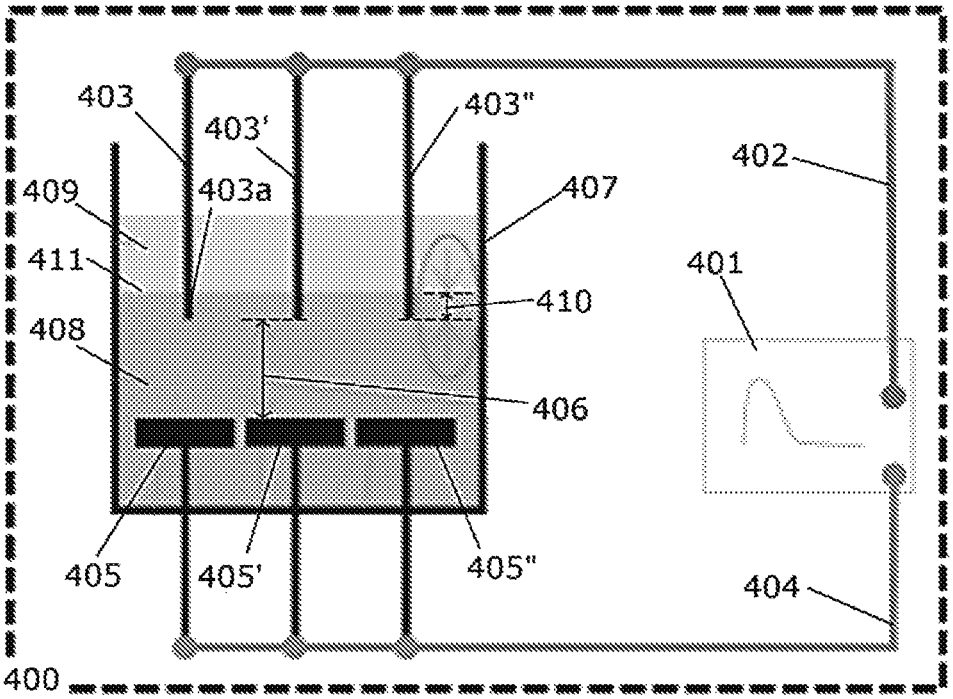
FIG. 2C is a diagram of one embodiment of an in-liquid plasma device containing multiple electrode pins and multiple metallic plate cathodes.

FIG. 2B depicts an embodiment having a plurality of anodes (303, 303', 303") and a plurality of cathodes (305, 305', 305"), forming a plurality of anode-cathode pairs. There can generally be any number of anodes and cathodes, i.e., any number of anode-cathode pairs, e.g. about 1 to 100, about 1 to 20, about 1 to 10, or about 2 to 8. FIG. 2C depicts another embodiment with a plurality of anodes (403, 403', 403") and a plurality of cathodes (405, 405', 405") that are metal plates forming a plurality of anode-cathode pairs. The cathode(s) can be a metallic rod, a metallic wire, a metallic needle, a metallic plate, or a combination thereof. In some embodiments the container has a metal wall and the cathode is the metal wall.

The device can include a low-dielectric material configured to form an interface with the liquid when the liquid is in the container. The low-dielectric material can have a dielectric constant of about 1 to 50, about 1 to 25, about 1 to 10, about 1 to 5, or about 2 to 5. The low-dielectric material can be a solid such as $Al_2O_3$, $BaF_2$, $CaF_2$, $SrF_2$, polyethylene, polyvinyl chloride, or teflon. The low-dielectric material can be a liquid such as n-heptane, cyclohexane, or toluene. The low-dielectric material can be a gas such as argon, helium, oxygen, carbon dioxide, nitrogen, or air. The interface can be separated from the end of the anode by a distance of about 0.0 mm to 10.0 mm, about 0.0 mm to 5.0 mm, about 0.0 mm to 4.0 mm, about 0.2 mm to 4.0 mm, about 0.2 mm to 1.0 mm, about 0.2 mm to 0.8 mm, or about 0.4 mm to 2.0 mm.

The device can include a high-voltage power supply coupled to the anode. The power supply can be a pulsed power supply, an alternating current (AC) power supply, or a direct current (DC) power supply. The power supply can supply large voltages to the electrodes, e.g., up to about 300 kilovolts. The voltage can be up to 200 kilovolts, 1 kilovolt to 200 kilovolts, 10 kilovolts to 200 kilovolts, 20 kilovolts to 200 kilovolts, about 20 kilovolts to 180 kilovolts, about 20 kilovolts to 160 kilovolts, or about 20 kilovolts to 140 kilovolts. In some embodiments the power supply is a pulsed power supply providing a pulse amplitude of about 1 kV to 100 kV, about 10 kV to 100 kV, about 10 kV to 50 kV, or about 10 kV to 20 kV. The pulsed power supply can have a pulse width of about 1 ns to 1000 ns, about 5 ns to 1000 ns, about 5 ns to 500 ns, about 5 ns to 250 ns, about 5 ns to 50 ns, or about 10 ns to 50 ns. The pulsed power supply can have an operating frequency of about 1 Hz to 1000 Hz, about 1 Hz to 500 Hz, about 1 Hz to 100 Hz, about 50 Hz to 500

Hz, or about 1 Hz to 50 Hz. The device can also include a ground source coupled to the cathode.

FIG. 2A depicts one embodiment of a device 200 for forming a plasma in a liquid 208. The device 200 has a container 207 configured to hold the liquid 208. A high-voltage power supply 201 is coupled via a lead 202 to an anode 203. The ground 204 is coupled to the cathode 205. In this device 200 the cathode 205 is a metal plate. The cathode 205 and the end of the anode 203*a* are separated by a distance 206 such as above, for example of about 2.5 mm. The cathode 205 and the end of the anode 203*a* are configured in the container 207 such that they are submerged in the liquid 208 when in the container 207. The liquid 208 can be water. A dielectric material 209, for example n-heptane, contacts the liquid 208 to form an interface 211. The interface 211 is separated from the end of the anode 203*a* by a distance 210 such as above, for example about 0.0 mm to 4.0 mm.

FIG. 2B depicts one embodiment of a device 300 for forming a plasma in a liquid 308. The device 300 has a container 307 configured to hold the liquid 308. A high-voltage power supply 301 is coupled via a lead 302 to a plurality of anodes (303, 303', 303"). The ground 304 is coupled to a plurality of cathodes (305, 305', 305"). In this device 300 the cathodes (305, 305', 305") are metal pins. The anode 303 and cathode 305 form one of a plurality of anode-cathode pairs. Although there can be any number of pairs, in this device 300 there are three pairs. The cathodes 305, 305', 305" and the ends, for example end 303*a*, of the anodes 303, 303', 303" are separated by a distance 306 such as above, for example of about 2.5 mm. In an aspect, the pairs of the cathodes and the ends of the anodes are each separated by the same distance. They may also be separated by different distances, however. The cathodes and the ends of the anodes are configured in the container 307 such that they are submerged in the liquid 308 when in the container 307. The liquid 308 can be water. A dielectric material 309, for example n-heptane, contacts the liquid 308 to form an interface 311. The interface 311 is separated from the ends of the anodes, for example the end 303*a* of the anode 303 by a distance 310, for example about 0.0 mm to 4.0 mm. In an aspect, the interface and all of the ends of the anodes are each separated by the same distance. They may also be separated by different distances, however.

FIG. 2C depicts one embodiment of a device 400 for forming a plasma in a liquid 408. The device 400 has a container 407 configured to hold the liquid 408. A high-voltage power supply 401 is coupled via a lead 402 to a plurality of anodes (403, 403', 403"). The ground 404 is coupled to a plurality of cathodes (405, 405', 405"). In this device 400 the cathodes (405, 405', 405") are metal plates. The anode 403 and cathode 405 form one of a plurality of anode-cathode pairs. Although there can be any number of pairs, in this device 400 there are three pairs. The cathode 405 and the end of the anode 403*a* are separated by a distance 406, for example of about 2.5 mm. The pairs of the cathodes and the ends of the anodes each can be separated by the same distance or by different distances. The cathodes and the ends of the anodes are configured in the container 407 such that they are submerged in the liquid 408 when in the container 407. The liquid 408 can be water. A dielectric material 409, for example n-heptane, contacts the liquid 408 to form an interface 411. The interface 411 is separated from the end of the anode 403*a* by a distance 410, for example about 0.0 mm to 4.0 mm. In various aspects, the interface and all of the ends of the anodes are each separated by the same distance, or by different distances.

Figure 2D:
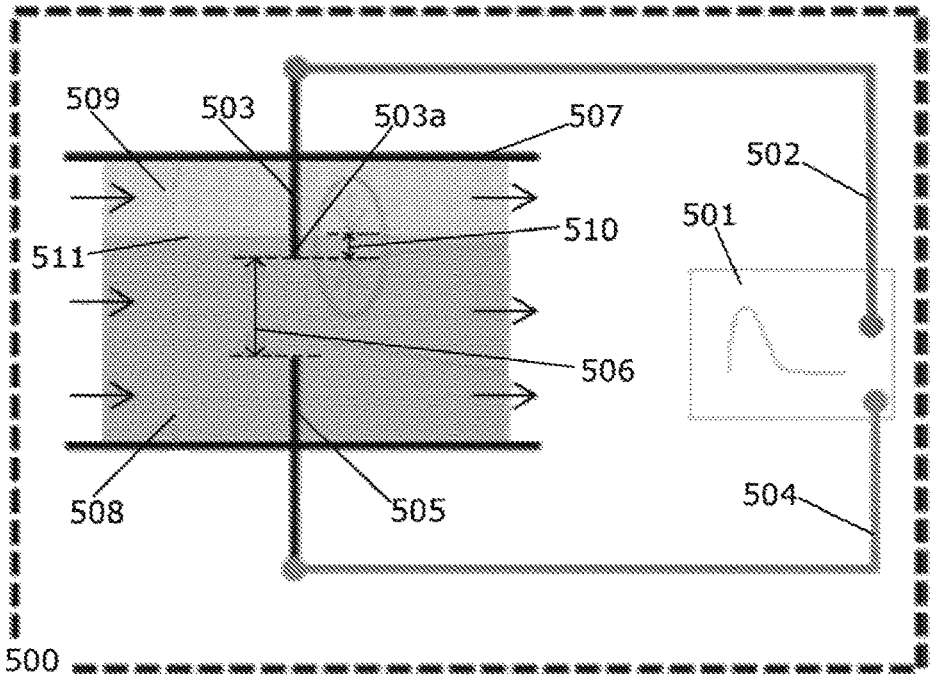
FIG. 2D is a diagram of one embodiment of an in-liquid plasma device configured for continuous treatment of a liquid flowing through the device.

FIG. 2D depicts one embodiment of a device 500 for forming a plasma in a liquid 508. The device 500 has a container 507 configured to hold the liquid 508. In this embodiment the container 507 is configured such that the liquid can pass through the container for continuous operation. A high-voltage power supply 501 is coupled via a lead 502 to an anode 503. The ground 504 is coupled to the cathode 505. In this device 500 the cathode 505 is a metal plate. The cathode 505 and the end of the anode 503*a* are separated by a distance 506, for example of about 2.5 mm. The cathode 505 and the end of the anode 503*a* are configured in the container 507 such that they are submerged in the liquid 508 when in the container 507. The liquid 508 can be water. A dielectric material 509, for example n-heptane, contacts the liquid 508 to form an interface 511. The interface 511 is separated from the end of the anode 503*a* by a distance 510, for example about 0.0 mm to 4.0 mm.

Figure 6A:
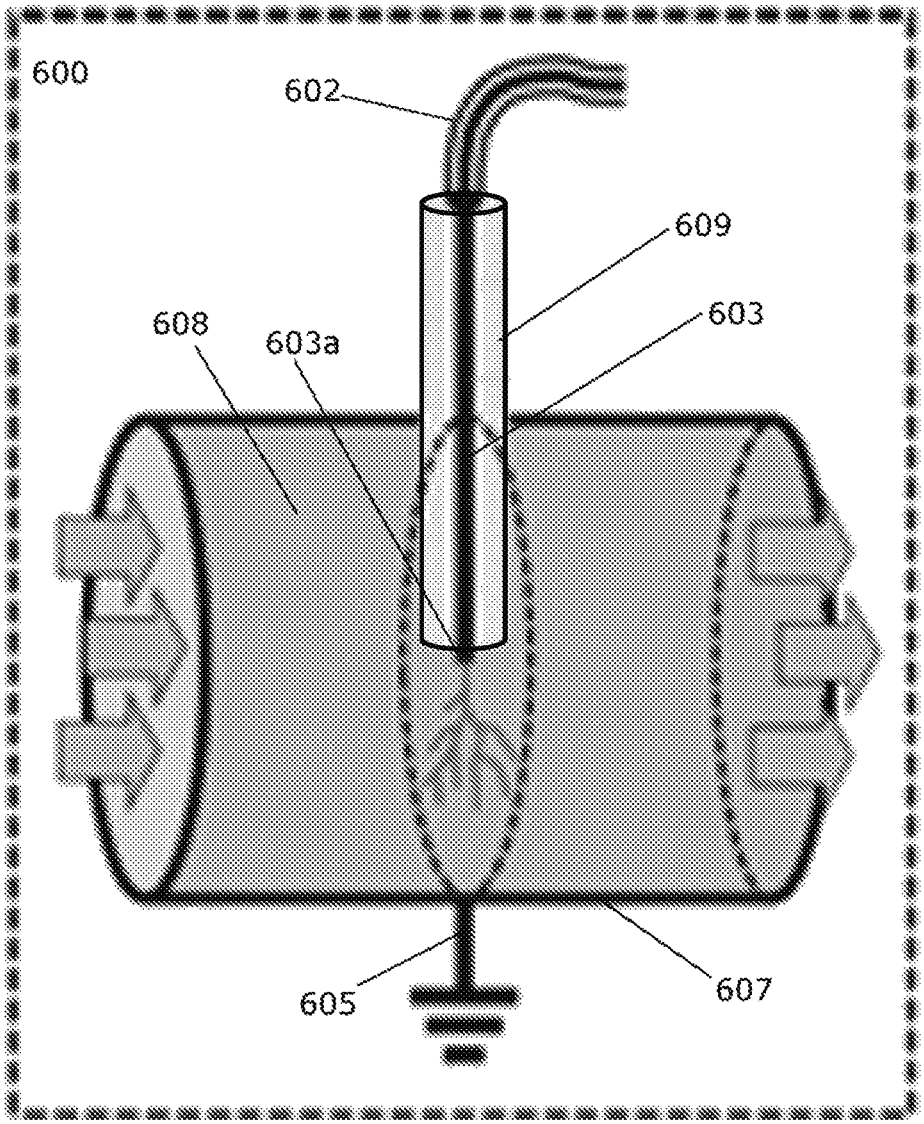
FIG. 6A is a diagram of one embodiment of an in-liquid plasma device for continuous flow operation.
Figure 6B:
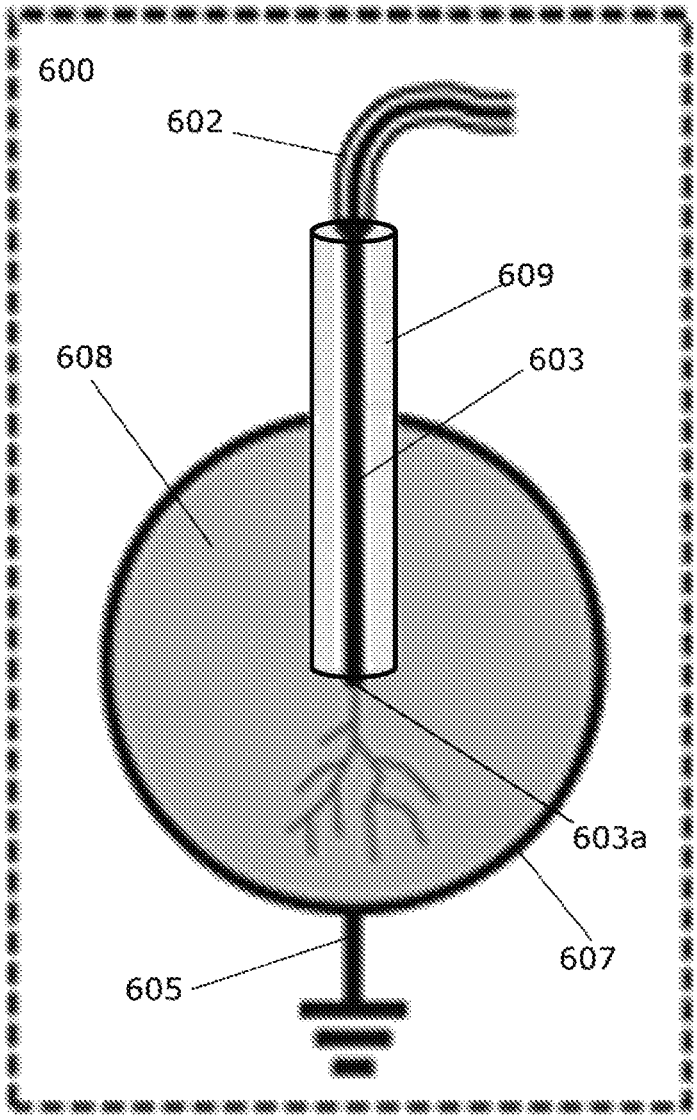
FIG. 6B is a sectional view of the in-liquid plasma device of FIG. BA.
Figure 6C:
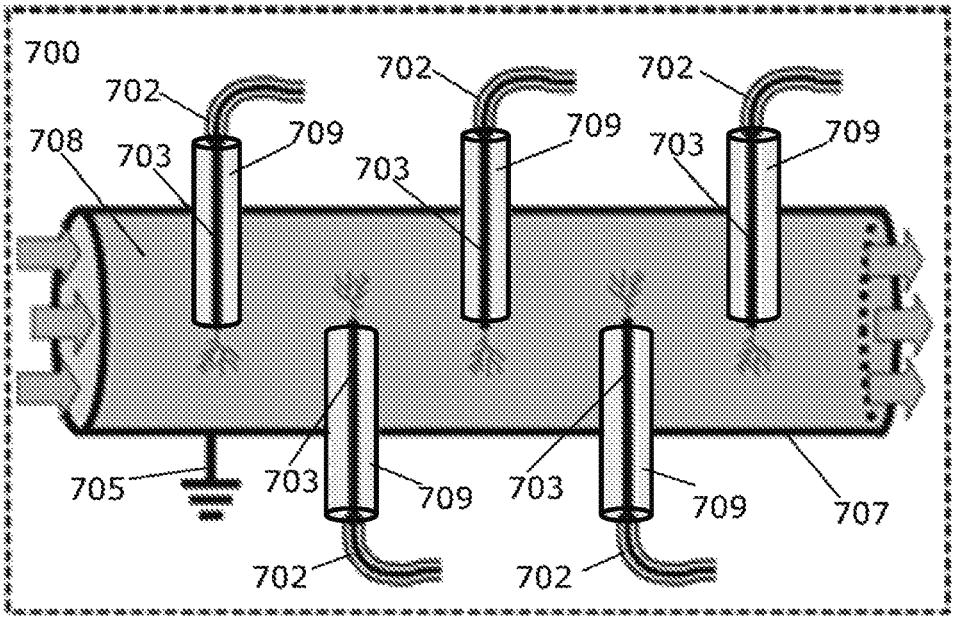
FIG. 6C is a diagram of an in-liquid plasma device for continuous flow operation and having multiple plasma generating pins.

The device can be configured for continuous operation in a commercial setting. FIGS. 6A and 6B depict one embodiment of a device 600 configured for continuous operation in a commercial setting. The anode 603 can be a metallic pin inserted through the low-dielectric material 609 and can be connected to a lead 602 which can be connected to a power source (not pictured). An end of the anode 603*a* extends from the low-dielectric material 609 by a distance, for example about 0.2 mm to 4.0 mm. The container 607 can be a metallic pipe that can also serve as the cathode. The container 607 is connected to a ground source 605. The liquid 608 can flow through the container 607 and contact the end of the anode 603*a* and the low-dielectric material 609. FIG. 6C shows an embodiment of a device 700 similar to that of device 600, but having a plurality of the anodes 703 each inserted through a low-dielectric material 709, each connected to a lead 702 and one or more power sources (in series or in parallel, not pictured). There can theoretically be any number of the anodes 703. In this particular embodiment there are 5. The container 707 can be a metal pipe connected to the ground 705. The liquid 708 can flow through the container 707 and contact the anodes 703 and the low-dielectric material 709.

Methods of In-Liquid Plasma Generation

Methods of generating a plasma in a liquid are provided. The methods can include using one or more of the devices provided herein. The methods can also include using devices not specifically described herein, and such methods are intended to be covered by the disclosure and accompanying claims. The methods can be performed at a variety of temperatures, for example about 5° C. to 40° C., about 10° C. to 30° C., about 15° C. to 25° C., or about 20° C. The methods can include contacting the liquid with a low-dielectric material for form an interface. The low-dielectric material can have a dielectric constant of about 1 to 50, about 1 to 25, about 1 to 10, about 1 to 5, or about 2 to 5. The low-dielectric material can be a solid such as $Al_2O_3$, $BaF_2$, $CaF_2$, $SrF_2$, polyethylene, polyvinyl chloride, or teflon. The low-dielectric material can be a liquid such as n-heptane, cyclohexane, or toluene. The low-dielectric material can be a gas such as argon, helium, oxygen, carbon dioxide, nitrogen, or air.

The methods can include submerging an anode in the liquid. An end of the anode can be separated from the low-dielectric material, i.e., from the interface, by a distance of about 0.0 mm to 10.0 mm, about 0.0 mm to 5.0 mm, about 0.0 mm to 4.0 mm, about 0.2 mm to 4.0 mm, about 0.2 mm to 1.0 mm, about 0.2 mm to 0.8 mm, or about 0.4 mm to 2.0 mm. The liquid can be two or more liquids, and the interface can be the interface between two or more immiscible liquids.

The methods can include contacting a cathode to the liquid and/or submerging a cathode in the liquid such that there is a gap between the anode and the cathode. In various embodiments, the cathode and an end (a first end) of the anode are separated by a distance of about 1.0 mm to 10.0 mm, about 1.0 mm to 3.0 mm, about 2.0 mm to 3.0 mm, or about 2.5 mm. The electrodes can be made from a variety of materials capable of withstanding the high voltages, e.g., that have a high melting point to withstand the high temperatures that can be generated. The electrode can contain iron, copper, tungsten, gold, platinum, or alloys or combinations thereof.

The methods can include applying a voltage to the anode to form a plasma in the liquid. The voltage can be a pulsed, an alternating current (AC), or a direct current (DC). The voltage can be up to about 300 kilovolts. The voltage can be up to 200 kilovolts, 1 kilovolt to 200 kilovolts, 10 kilovolts to 200 kilovolts, 20 kilovolts to 200 kilovolts, about 20 kilovolts to 180 kilovolts, about 20 kilovolts to 160 kilovolts, or about 20 kilovolts to 140 kilovolts. In some embodiments the power supply is pulsed with an amplitude of about 1 kV to 100 kV, about 10 kV to 100 kV, about 10 kV to 50 kV, or about 10 kV to 20 kV. The pulse can have a width of about 1 ns to 1000 ns, about 5 ns to 1000 ns, about 5 ns to 500 ns, about 5 ns to 250 ns, about 5 ns to 50 ns, or about 10 ns to 50 ns. The pulse can have a frequency of about 1 Hz to 1000 Hz, about 1 Hz to 500 Hz, about 1 Hz to 100 Hz, about 50 Hz to 500 Hz, or about 1 Hz to 50 Hz.

The methods can be used to generate a plasma in a variety of liquids. In some embodiments, the liquid has a dielectric constant of about 1 to 200, about 1 to 100, about 1 to 20, about 1 to 10, about 10 to 200, about 20 to 200, about 20 to 100, or about 40 to 100.

The liquid used by devices and methods as described herein can be water including wastewater, drinking water, sea water, etc. The methods can include water treatment or remediation to remove one or more contaminants in the water. The treatment of water (wastewater and drinking water) deals with the generation of oxidative species (hydrogen peroxide, oxygen and hydrogen molecules, hydroxyl, hydroperoxyl, hydrogen and oxygen radicals, as well as ozone) and physical phenomena (shock waves and cavitation) which are useful in the elimination many organic pollutants (phenols, trichloroethylene, polychlorinated biphenyl, organic dyes, aniline, etc.) and in the destruction and/or deactivation of many viruses, yeast, and bacteria.

The liquid can include a hydrocarbon source. A hydrocarbon source can be liquid hydrocarbons such as propane, n-butane, isobutane, n-hexane, n-octane, n-decane, n-tridecane, benzene, toluene, ethyl benzene, cyclohexane, gasoline, kerosene, lubricating oils, diesel oils, crude oils and mixtures thereof. A hydrocarbon source can be a substituted or unsubstituted silazane, such as hexamethyldisilazane (HMDSN). The methods can include hydrocarbon reformation. The treatment of liquid fuels deals with the reforming of hydrocarbons including low-grade oils to other valuable substances. This can be liquid-to-liquid or liquid-to-gas reforming. The liquids can include metal salts and/or ionic liquids.

As used herein, liquid can refer to a composition of one or more liquids. Liquid can refer to a composition of two immiscible liquids with an interface between the two liquids.

Following application of the voltage for a period of time, a period of rest can be instituted. During the period of rest, an interface layer can form at the interface. After a period of time, the interface layer can be removed from the liquid by syringe or other suitable means. The interface layer can then be dried with air, by vacuum, by application of heat, or by other methods known in the art. Drying the interface layer can result in isolated nanomaterials.

Methods of Nanomaterial Synthesis

The methods herein can also include nanomaterial synthesis. The synthesis of nanomaterial can originate from the dissociation of liquids and/or from the erosion of electrodes in the case of arcs. Depending on the liquids nature, a wide range of nanomaterial can be synthesized with relatively high yield of production.

For more than a decade, nanomaterials have attracted great attentions from many disciplines due to their unique material properties (electrical, optical, magnetic, catalytic, etc.) as compared to their bulk materials, and developing efficient synthesizing methods has been a challenge so far. Among various plasma-based techniques for the nanomaterial synthesis [Kruis 1998, Richmonds 2008, Sankaran 2005, Mariotti 2010], electrical discharges in liquids have shown technical potential toward a high-yield production [Belmonte 2014, Janiak 2013, Yonezawa 2010]. Another advantage in using in-liquid discharges can be confinement of synthesized nanomaterials inside the liquid minimizing their airborne side effects on our health and environment, thus a combination of post processes using the synthesized nanomaterials occurring in the same liquid is technically favorable. For example, suspended synthesized-nanoparticles in liquid was used for the production of nanocomposite thin films using dielectric barrier discharges [Fanelli 2014] or plasma jets [Fauchais 2008].

The synthesis of nanomaterials using in-liquid plasma-based techniques could be achieved using various methods, e.g., through plasma-induced electrode erosion [Hamdan 2014, Kabbara 2015] and plasma-induced liquid dissociation [Hamdan 2013a, Sano 2004, Graham 2011]. For the plasma-induced electrode erosion, two metallic electrodes are usually immersed in a dielectric liquid and applied electrical potential difference between the electrodes generates electrical discharges. Because of the relatively high temperature (~5000-10000 K) and pressure (~10-100 atm) in the discharge channel [Hamdan 2013b], the electrode surfaces melts down and emits the electrode matter resulting in the synthesis of nanomaterials. This technique has been incorporated in synthesizing metallic [Hamdan 2014] or semiconductor [Kabbara 2015] nanoparticles. To better control of the nanoparticles composition, the base dielectric liquids such as liquid-nitrogen or liquid-helium might be used to avoid the incorporation of species originated from the liquid into the synthesized material.

Depending on the selection of dielectric liquids, such as hydrocarbons or organosilicon, the produced species from the liquid due to discharges can agglomerate to form nanoparticles. In various aspects, two plasma synthesizing techniques to use dielectric liquids are provided. The same as the use of electrode erosion, two metallic electrodes immersed in the dielectric liquid are energized to generate plasma that dissociates the liquid component. The impurity from the electrode erosion can be a problem for the method. Thus the rate of erosion should be minimum [Hamdan 2013a]. Although, the synthesized materials can be multiphasic (alloys) or nanocomposites (nanoparticles embedded into matrix) when the dissociation of the dielectric liquid and the erosion of the electrode occur simultaneously, for a high purity material synthesis avoiding the electrode-erosion effect, electrode-free systems have been developed such as microwave discharges in liquids [Yonezawa 2010, Sato 2011].

Presented herein is a novel method, which comprises electrical discharges occurring at the interface of two immiscible dielectric liquids in a nanosecond scale. Although the previously reported production rate of nanoparticles using the in-liquid plasma-based techniques are relatively high (~20 mg/hour [Richmonds 2008]) as compared to gas phase plasmas (~0.1 mg/hour by RF atmospheric plasma [Askari 2014] and ~3 mg/hour by spark discharge [Muntean 2016]), further increase in process efficiencies can facilitate practical applications to various industrial processes.

Thus, the present methods can address a technical progress regarding the production of nanomaterials with high efficiency, for example in particular the production of hydrogenated SiOC nanoparticles. As reported in previous literature [Maex 2003, Seong 2004, Zhou 2006, Gallis 2009, Moysan 2007, Du 2012, Nastasi 2015, Zhuo 2005], hydrogenated SiOC has low dielectric constant and of interest material properties for numerous electronic, optical, thermal, mechanical, nuclear, and biomedical applications. Moreover, SiOC nanoparticles are the feedstock for other families of nanomaterials such as SiC nanowires [Zhang 2010]. In general, the composition of low dielectric constant materials is amorphous carbon-doped glass materials comprising Si, C, O, and H. The materials can be hydrogenated SiOC. Hydrogenated SiOC are also known by various names such as SiOCH, SiOC, carbon-doped oxides (CDO), silicon-oxicarbides, or organosilicate glasses (OSG); the term of SiOC:H will be used throughout to refer the synthesized material in the present study.

In an embodiment, the present method to synthesize SiOC:H is based on electrical discharges at the interface of hexamethyldisilazane ($(CH_3)_3SiNHSi(CH_3)_3$) and water ($H_2O$) liquids. The synthesized material was characterized using Fourier transform infra-red (FT-IR), scanning and transmission electron microscopies (SEM and TEM), and X-ray photoelectron spectroscopy (XPS). As a result, these results could successfully demonstrate a novel approach highlighting efficient synthesis of SiOC:H.

EXAMPLES

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is in bar. Standard temperature and pressure are defined as 0° C. and 1 bar.

Example 1

An example is presented that shows the effect of the position of the interface liquid-dielectric on the plasma shape and on the probability of discharges. The liquid to be treated was water (dielectric constant ~80). The material with low dielectric constant is liquid n-heptane (dielectric constant ~2). A geometrical configuration as presented in FIG. 1 was used. The gap distance between the anode and cathode is 2.5 mm. The high-voltage power supply provides a pulse of amplitude 15 kV and width of 10 ns. The operating frequency was 1 Hz.

Figure 3:
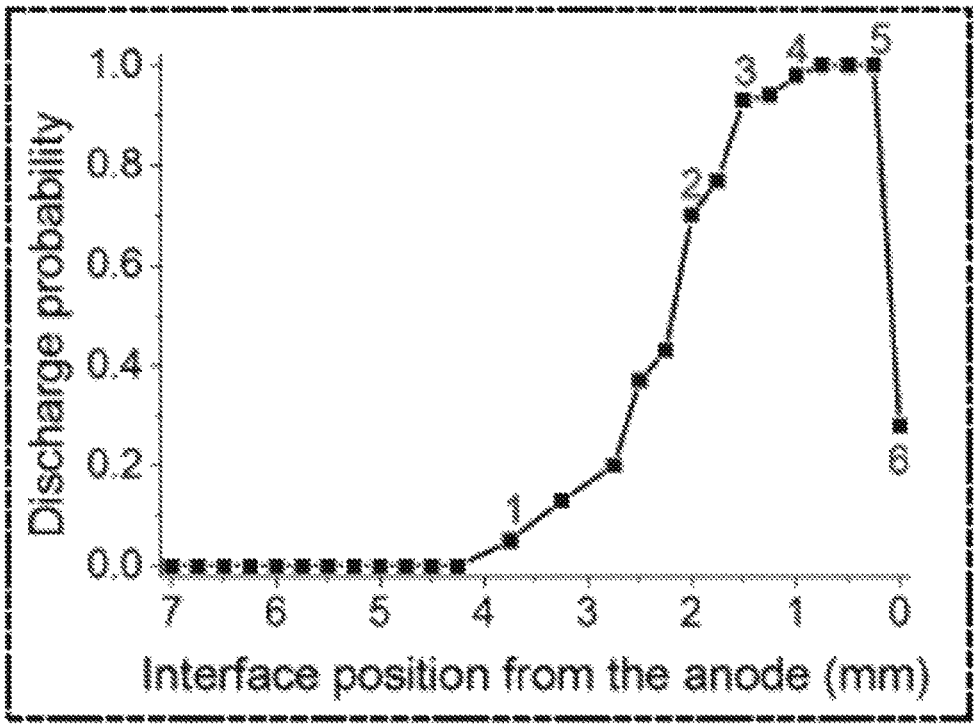
FIG. 3 is a graph of the discharge probability as a function of the distance between the interface and the head of the anode (mm).

Discharges in liquids are stochastic in nature and the concept of discharge probability was introduced. Discharge probability is the percentage of how much discharges occurred by applying a number (here about 200) of high-voltage pulses. The discharge probability variation as a function of the interface water-heptane distance from the head of the anode is presented in FIG. 3.

The results demonstrated that, if the position of the interface from the tip of the anode is between 0.2 and 1 mm, the discharge probability can reach 100%. If the position of the interface from the head of the anode is longer than 4 mm, the discharge probability can reach 0%. If the position of the interface is lower than the tip of the anode, the discharge probability can be 0%.

Figure 4:
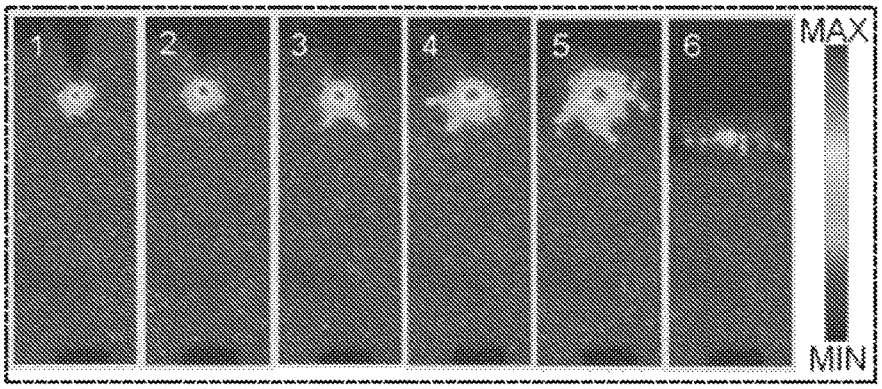
FIG. 4 is an experimental intensity map of the plasma shape as a function of the position of the interface. The positions are labeled 1-6 in FIG. 3.

The plasma shape dependence on the interface position is shown in FIG. 4. When the interface position approaches to the tip of the anode (from 4 to 0.2 mm), the volume of the plasma increased (see frames from 1 to 5). The frame number corresponds to the same number indicated in the plot of the discharge probability presented in FIG. 3. When the interface is close to the tip of the anode (>0 and <0.2 mm), the plasma can propagate along the water-heptane interface. Because of the dissociation of molecules, the reforming of heptane and the synthesis of carbonaceous nanomaterial become important when the plasma is at the interface.

Figure 5:
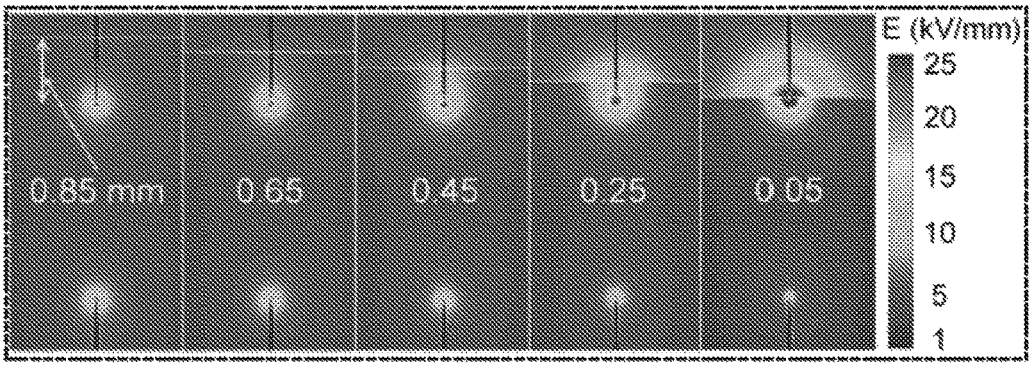
FIG. 5 is a computed field intensity map as a function of the distance between the interface and the head of the anode.

These experimental results were also supported by simulating the electric field distribution using COMSOL Multiphysics. The geometry of the electrodes and made two-dimensional simplifications was simplified for the simulations. The upper electrode is an anode (+15 kV) and the lower electrode is a cathode (ground). The down-side liquid is water, and the up-side liquid is heptane. The interface position is shown as a horizontal white line (FIG. 5). The number in each frame is the distance of the interface from an end or the head of the anode. The results show that as the interface approaches the end or head of the anode i) the intensity of the electric field can increase which can explain why the discharge probability increased and ii) the volume of the high-electric field region can increase which can explain why the dimension of the plasma also increased.

Example 2

The possibility of synthesizing nanomaterials was also investigated. In an aspect, the synthesis of hydrogenated SiOC-low dielectric constant material—by creating electrical discharge at the interface of hexamethyldisilazane and water was investigated. This innovative technique showed a relatively high production rate up to ~17 mg per minute. Various techniques, such as Fourier transform Infra-Red, scanning and transmission electron microscopies, and X-ray photoemission spectroscopy, were adopted to characterize the synthesized material. The results show that the synthesized materials are hydrogenated SiOC nanoparticles. The heating at 500° C. for two hours allows the release of hydrogen from CHx groups and the evaporation of volatile compounds such as hydrocarbons. The presented work shows that techniques as described herein can be used for high production rate of nanoparticles, in particular low dielectric constant material for microelectronic applications.

Experimental Setup

Figure 7:
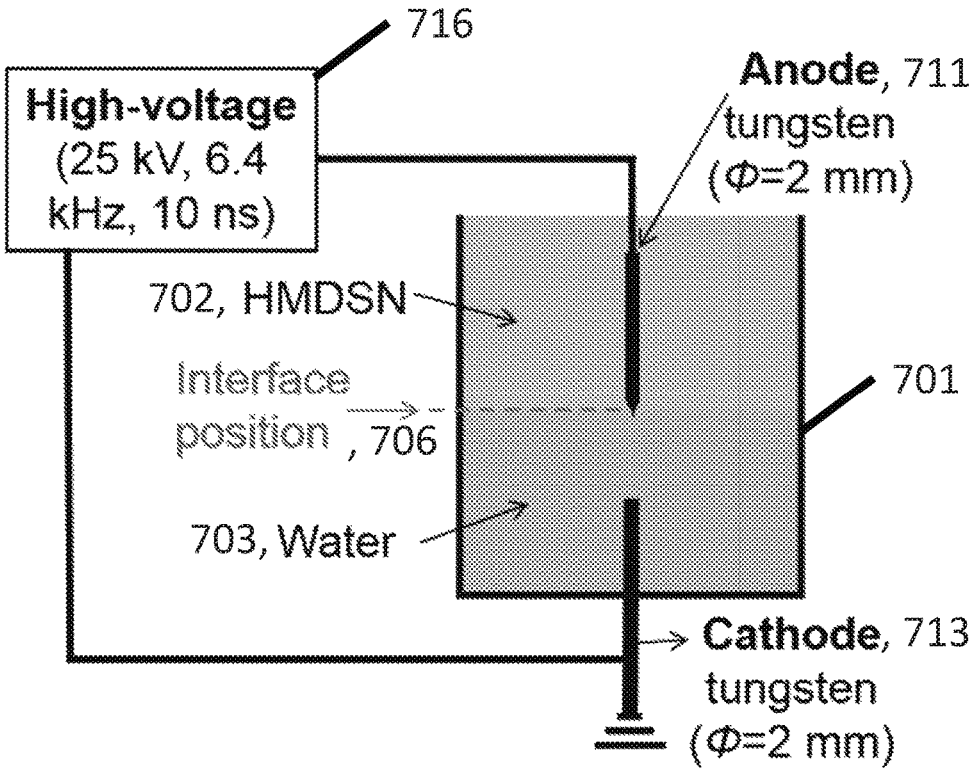
FIG. 7 is a schematic of an experimental setup as used herein.

A 5×5×10-cm quartz test cell was filled with 100 $cm_3$ of distilled water (dielectric permittivity (E) of 80) and 100 $cm_3$ of hexamethyldisilazane (HMDSN, e=2.2) as schematically shown in FIG. 7. The set up included a container 701 configured to hold a plurality of immiscible dielectric liquids. The plurality of dielectric liquids comprised a first liquid 702 and a second liquid 703, wherein the first liquid and the second liquid are immiscible forming an interface 706 between the first liquid 702 and the second liquid 703. The container also comprised one or more anode 711 and cathode 713 pairs. The one or more anode and cathode pairs respectively were immersed in the plurality of immiscible dielectric liquids, an anode of an anode and cathode pair immersed on a side of the interface opposite the cathode, the one or more anode and cathode pairs in electric communication with a power source 716. In this example, the first liquid was hexamethyldisilazane (HMDSN) and the second liquid was water, though as described herein other liquids can be used.

Because the density of HMDSN (0.77 g/cm3) is lower than that of water (1 g/cm3) and HMDSN is non-polar, these two liquids are immiscible and a sharp interface between these two layers was present. Two electrodes made of a tungsten rod (purity of 99.95%, diameter of 2.0 mm) were vertically submerged in a manner that the tip of the high-voltage anode (upper) was located at the interface of two liquids, while the ground electrode (lower) was placed 10 mm below the anode in water. The tip of the anode was sharpened to have a radius of curvature ~50 μm, while the end of the ground electrode was kept flat. A very short positive high voltage was applied to the anode using a nanosecond pulse power supply (FID, FPG-25-15NM), with a full width at half maximum of ~10 ns.

A FT-IR spectrometer (Nicolet, 6700) was used to analyze the composition of the liquid and solid samples based on absorption spectra in the range of 500-4000 $cm^{-1}$ with a spectral resolution of 4 $cm^{-1}$. A Magellan XHR 400 FEG and Quanta 200 FEG were employed as SEM analysis for high resolution imaging and energy-dispersive X-ray (EDX) analysis, respectively. TEM was adopted to the samples using Titan 60-300 ST (FEI) electron microscope, which was equipped with a spherical aberration corrector for its objective lens to achieve high resolution TEM analysis. The morphology of the nanomaterials was investigated by acquiring low magnification images in bright-field TEM mode. The selected area electron diffraction (SAED) patterns were also acquired to investigate the crystal structure of nanomaterials. XPS studies were carried out in a Kratos Axis Ultra DLD spectrometer equipped with a monochromatic Al Kα X-ray source (hv=1486.6 eV) operating at 150 W, a multi-channel plate and a delay line detector under a vacuum of ~$10^{-9}$ mbar. Measured spectra were recorded using an aperture slot of 300 μm×700 μm. The survey and high-resolution spectra were collected at fixed analyzer pass energies of 160 and 20 eV, respectively. Samples were mounted in floating mode in order to avoid differential charging; charge neutralization was required for all samples.

Results and Discussion

It was recently shown that the discharge at the interface of two dielectric liquids, with different ε, can create plasma channel along the interface which was able to dissociate both liquids at the interface [Hamdan 2016]. In addition, when the location of a high-voltage anode was closer to the interface between the two liquids, the local field intensity near the anode tip became stronger, which can result in facilitating the discharge and increasing the plasma volume. It was hypothesized that applying similar techniques to the present SiOC:H synthesis may increase its production efficiency.

Figures 8A, 8B, 8C:
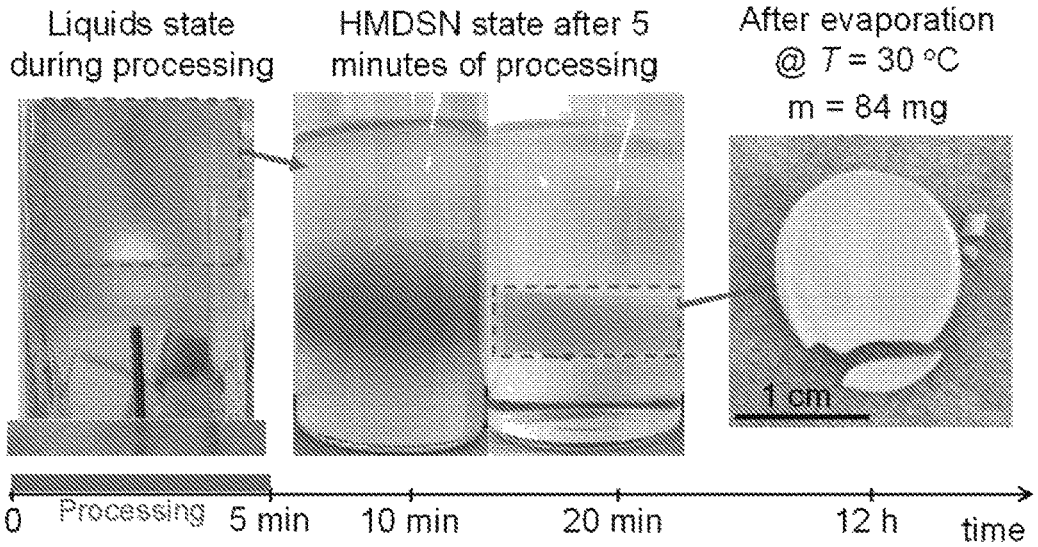
FIG. 8A is a photograph showing embodiments of the liquids state during processing.
FIG. 8B is a photograph showing an embodiment of hexamethyldisilazane (HMDSN) state after 5 minutes of processing.
FIG. 8C shows an embodiment of the state after evaporation.

Under the aforementioned experimental condition, a change in colors for both liquids after 5 minutes duration of the discharges was observed; the HMDSN became dark-tan and the water became milky as shown in FIGS. 8A-8B. After 5 minutes resting time (total 10 min elapsed), a clear color separation of the liquid was observed (FIG. 8B, time=10 min). Another 10 minutes later (total 20 min elapsed), the dark-tan zone in the middle became completely separated from the colorless liquids: water (bottom) and HMDSN (top), confirmed using FT-IR analysis. Then, the dark-tan colored solution was collected using a syringe and dried in air resulting in a compact solid material with off-white color (FIG. 5C, time=12 h). Note that the mass of the synthesized material was around 84 mg per 5 minutes, i.e., indicating a high efficiency of the process as compared to other plasma-based techniques [Richmonds 2008, Askari 2014, Muntean 2016].

Characterization of the Synthesized Nanomaterial (at Room Temperature)

Figure 9A:
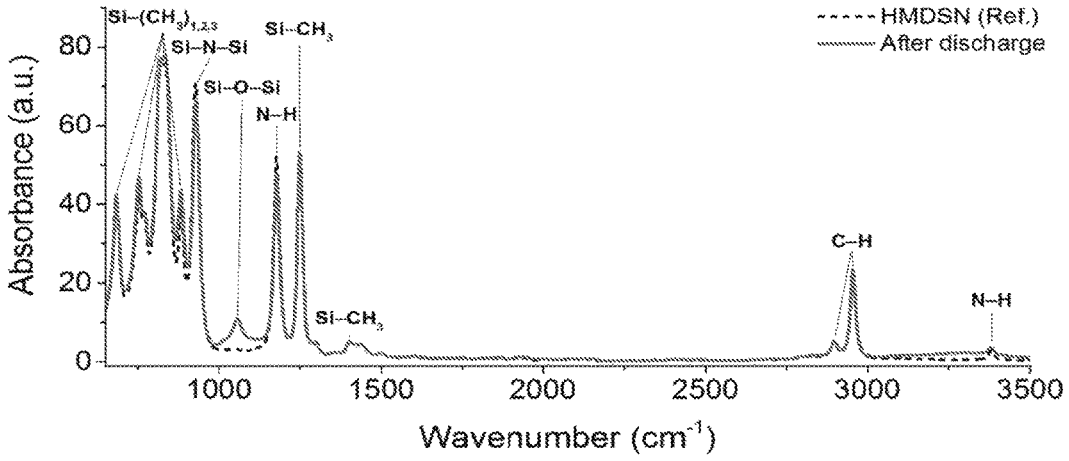
FIG. 9A depicts Fourier transform infrared (FT-IR) spectroscopy data (absorbance) for an embodiment of HMDSN liquid before and after plasma processing of 5 minutes.
Figure 9B:
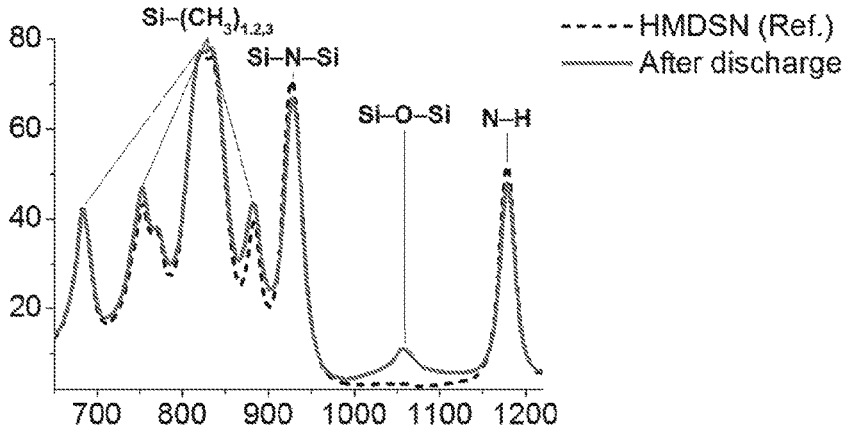
FIG. 9B is a zoomed view of the data of FIG. 9A showing 650 to 1200 $cm^{-1}$.

The plasma processed HMDSN, collected after 5 minutes of continuous discharge and 15 minutes of resting time (liquid sample), was analyzed using FT-IR and compared with the original HMDSN liquid as shown in FIGS. 9A-9B. The absorption peaks were identified and summarized in FIG. 10. Although the spectrum of processed liquid perfectly superimposed over the original one, some critical differences can be highlighted. The spectra from 650 to 1200 $cm^{-1}$, as shown in FIG. 9B, shows the following features:

i) The appearance of a peak at 1060 cm-1 is associated with Si—O—Si (stretching asymmetric vibration mode).

ii) The decrease in the peak intensities are those containing nitrogen, i.e., Si—N—Si at 928 $cm^{-1}$ and N—H at 1179 $cm^{-1}$.

iii) The increase in the background intensity from 3000 to 3500 cm-1 is due to OH vibration band.

These three facts indicate that the initial molecules of the two liquids (water and HMDSN) are dissociated, and the O atoms originating from the water dissociation ensure the formation of silicon-oxide-based materials. The formation of liquid by-products, such as alcohol and hexamethyidisiloxane $(CH_3)_3SiOSi(CH_3)_3$, may also be possible during the discharges and synthesizing nanoparticles. However, the volatile liquid was obtained to obtain solid nanoparticles only.

Figure 11A:
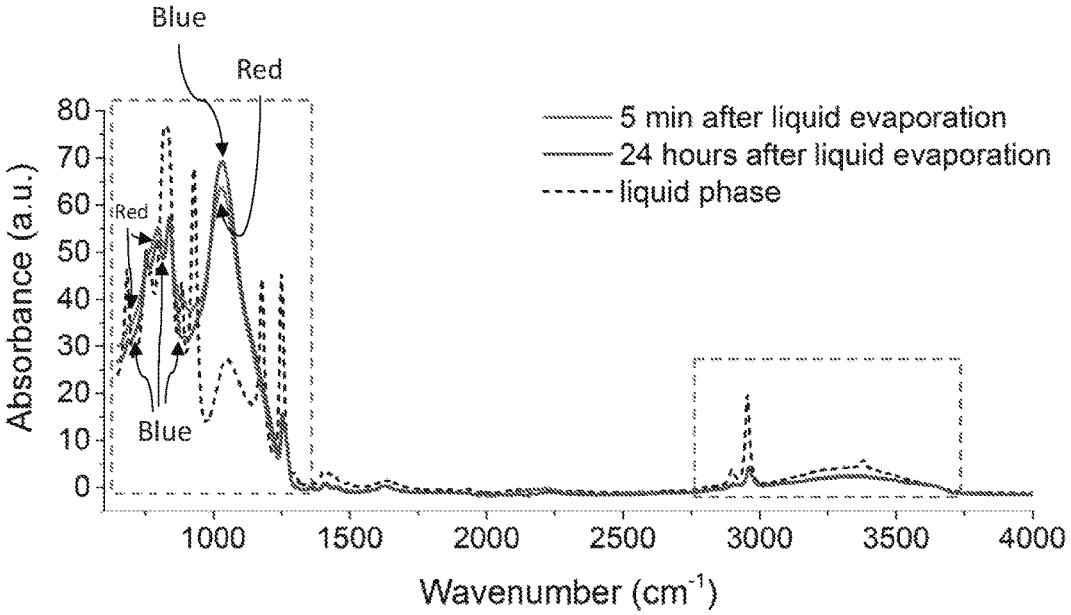
FIG. 11A depicts FT-IR spectra (absorbance) of an embodiment of the synthesized solid particles at 5 minutes (red) and 24 hours (blue) after liquid evaporation; the dashed line refers to the processed liquid.
Figure 11B:
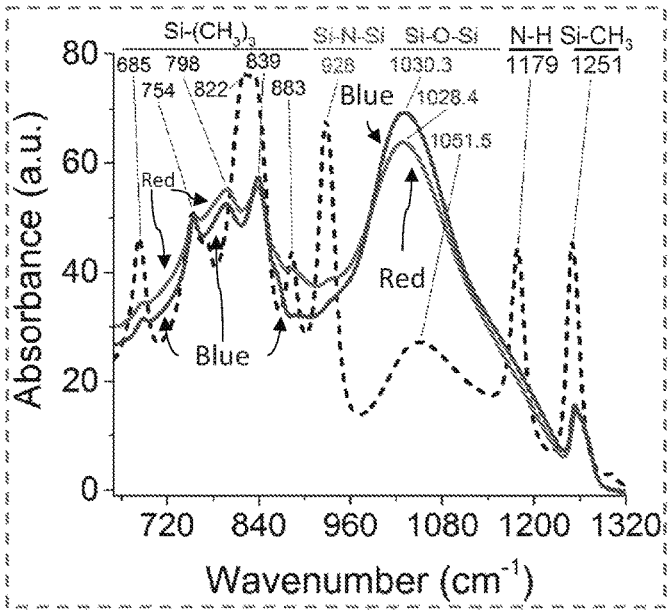
FIG. 11B depicts a zoomed view of the leftmost dashed box in FIG. 11A.
Figure 11C:
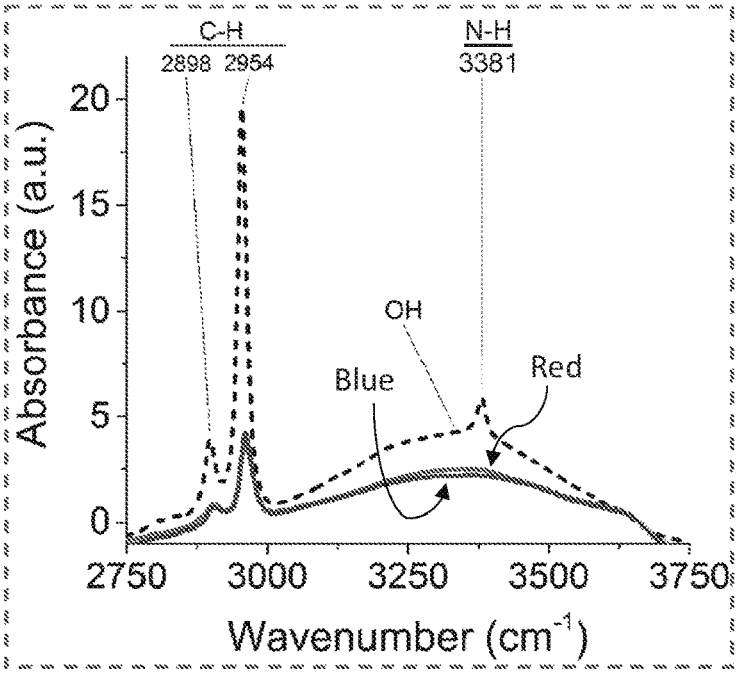
FIG. 11C depicts a zoomed view of the rightmost dashed box in FIG. 11A.

Further analysis was conducted on the solid particles, as the volatile liquid evaporated after 5 min and after 24 hours after plasma treatment, using FT-IR, and compared to the plasma processed liquid (FIGS. 11A-11C). It is worth mentioning that upon liquid evaporation, the spectrum was stabilized, as no major changes were observed between 5 minutes and 24 hours. Comparing with the plasma processed liquid, the vibrational bands of N-containing molecules (Si—N—Si at 928 $cm^{-1}$ and N—H at 1179 and 3381 $cm^{-1}$) appeared to completely disappear, indicating that the obtained solid particles are nitrogen free. The intensity of C—H vibrational bands at 2898 and 2954 $cm^{-1}$ decreased by a factor of four when the evaporation process dried out all liquid components. This indicates that the CH containing components were in HMDSN or in other CH-containing by-products (e.g. hydrocarbons). Also, the distribution of Si—$(CH_3)_{1,2,3}$ peaks, observed in a range of 650-900 $cm^{-1}$, was changed after the liquid evaporation indicating that the vibrational bands of Si—$(CH_3)_{1,2,3}$ originated from the liquid components may have disappeared. Although the data become less complex by only characterizing the solid phase, the existence of multiple peaks of Si—$(CH_3)_{1,2,3}$ indicates that there are multiple vibrational modes; a deconvolution of these peaks will be discussed in a forthcoming section.

Figure 12A:
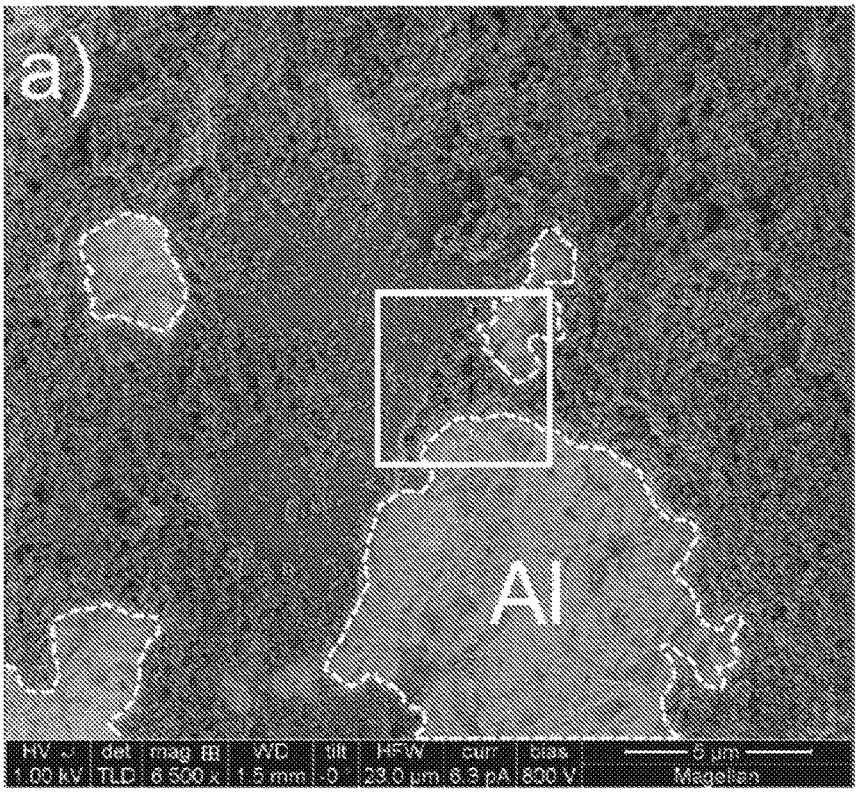
FIGS. 12A and 12B are low magnification scanning electron microscope (SEM) images of embodiments of nanoparticles deposited onto an embodiment of an aluminum substrate.
Figure 12B:
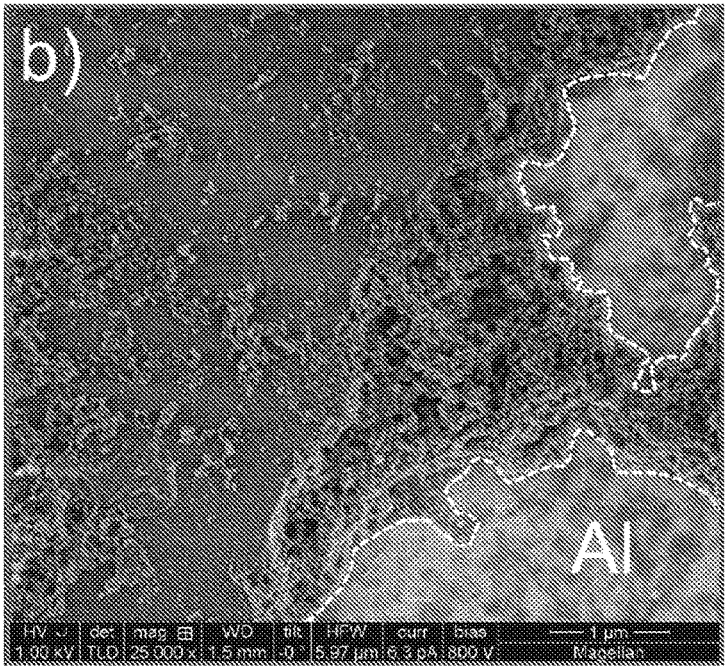
Figure 12C:
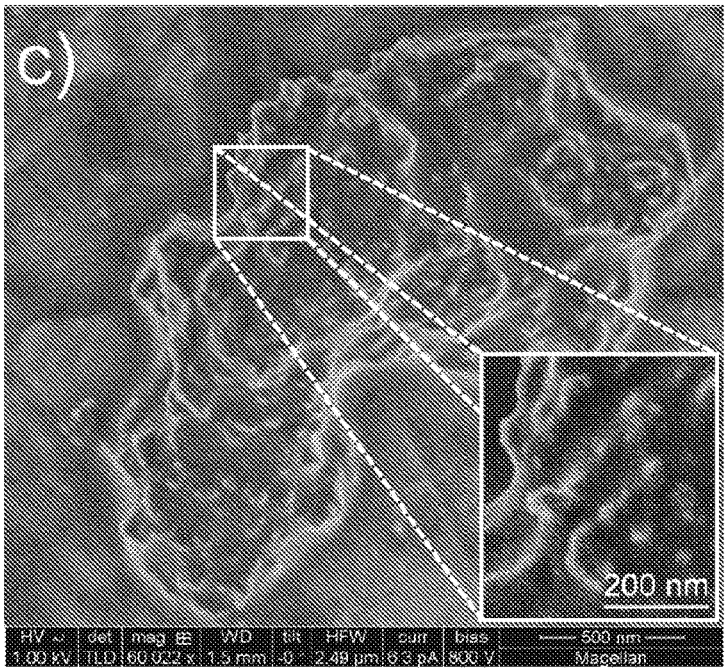
FIGS. 12C and 12D are SEM images which show embodiments of two kinds of nanomaterials produced in accordance with methods disclosed herein: gel-like and nanoparticles dispersed onto a sheet.
Figure 12D:
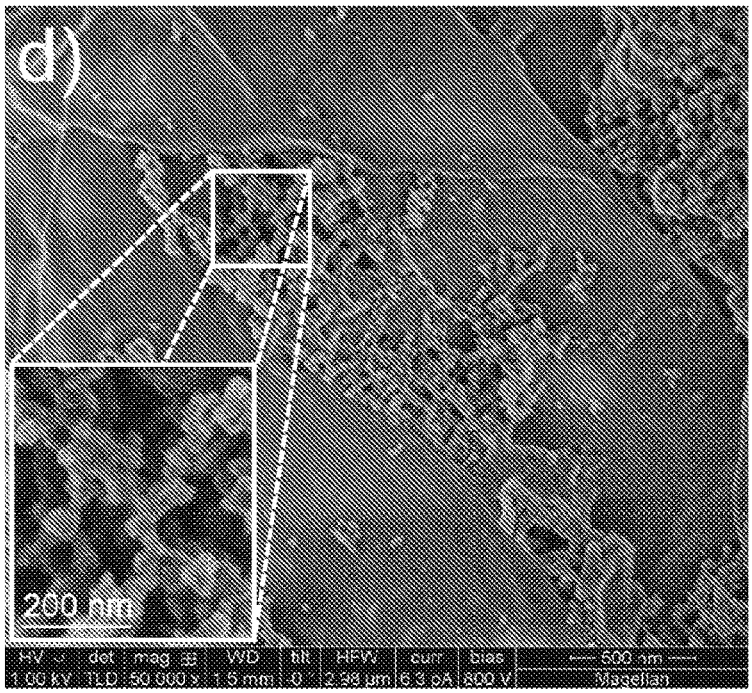

The morphology of the solid particles can be obtained using SEM, and examples of agglomerates of particles on an aluminum substrate are shown in FIGS. 12A-12D. These samples are prepared by evaporating (at room temperature) one droplet of the plasma processed liquid onto an aluminum plate. The material is composite-like showing nanoparticles embedded in a matrix. FIG. 12B also shows that the material is sandwich-like in which the nanoparticles are embedded. In fact, after observation of various regions on the sample, a conclusion can be that two families of materials are present. The first one can be composite-like where the nanoparticles are embedded into dense and homogeneous matrix (FIG. 12C). The second one can be an aggregate of nanoparticles, randomly dispersed onto the surface of the film (FIG. 12D). A sheet-like material is also identified, as shown in FIG. 12D, and this sheet does not show embedded nanoparticles; the nanoparticles are simply dispersed onto the surface of the sheet.

Figure 13A:
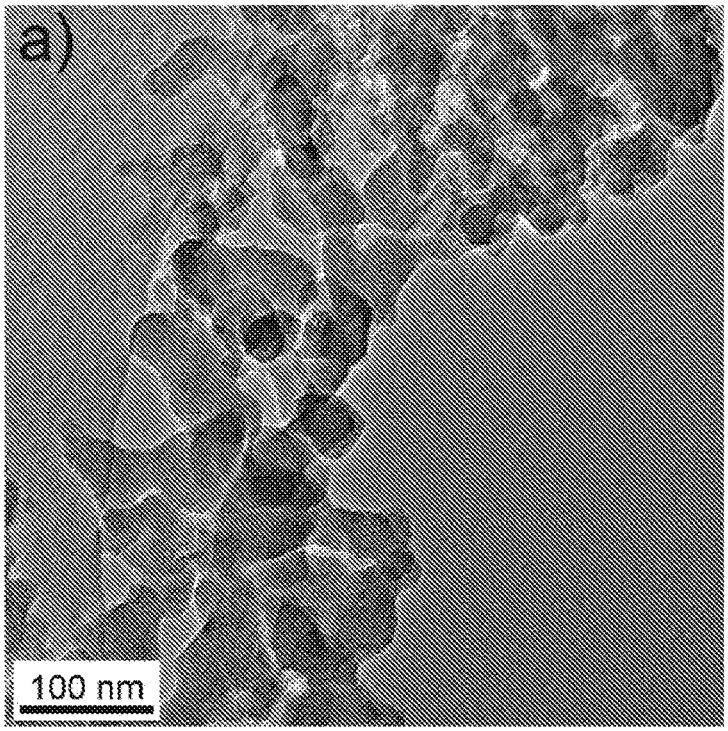
FIG. 13A is a transmission electron microscope (TEM) image of an embodiment of nanoparticles of the present disclosure at low magnification.
Figure 13B:
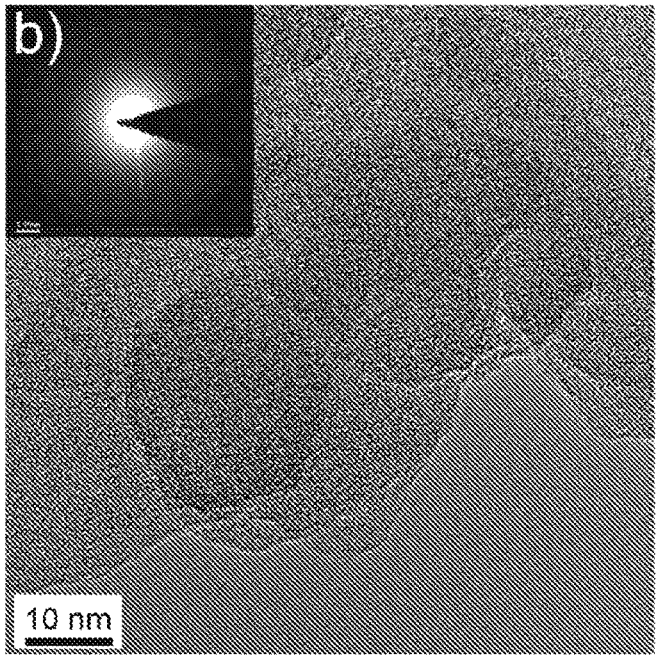
FIG. 13B is a transmission electron microscope (TEM) image of an embodiment of nanoparticles of the present disclosure at high magnification.
Figure 13C:
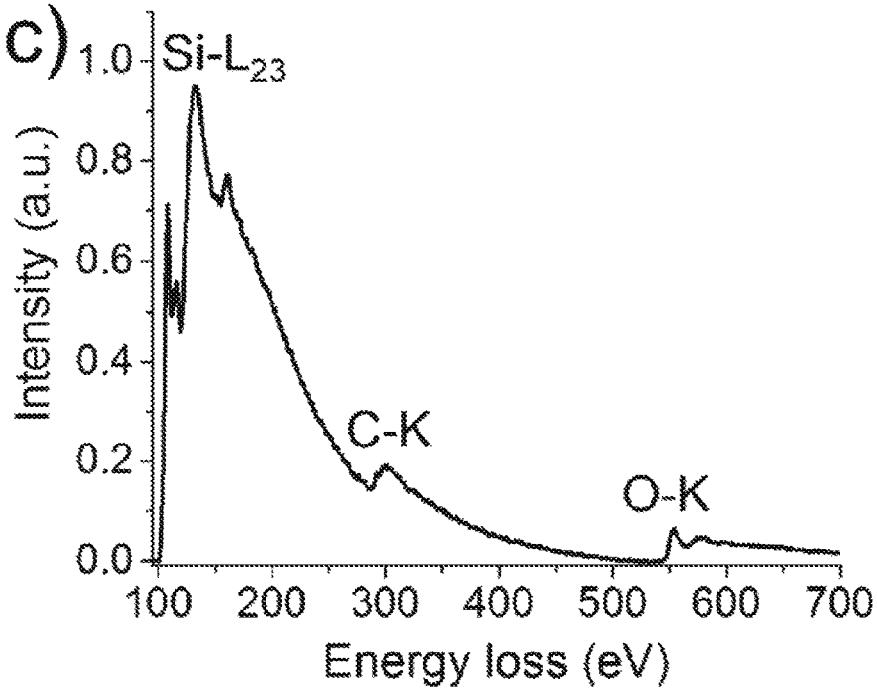
FIG. 13C shows electron energy loss spectroscopy (EELS) data showing the presence of Si, C, and O in embodiments herein.
Figure 13D:
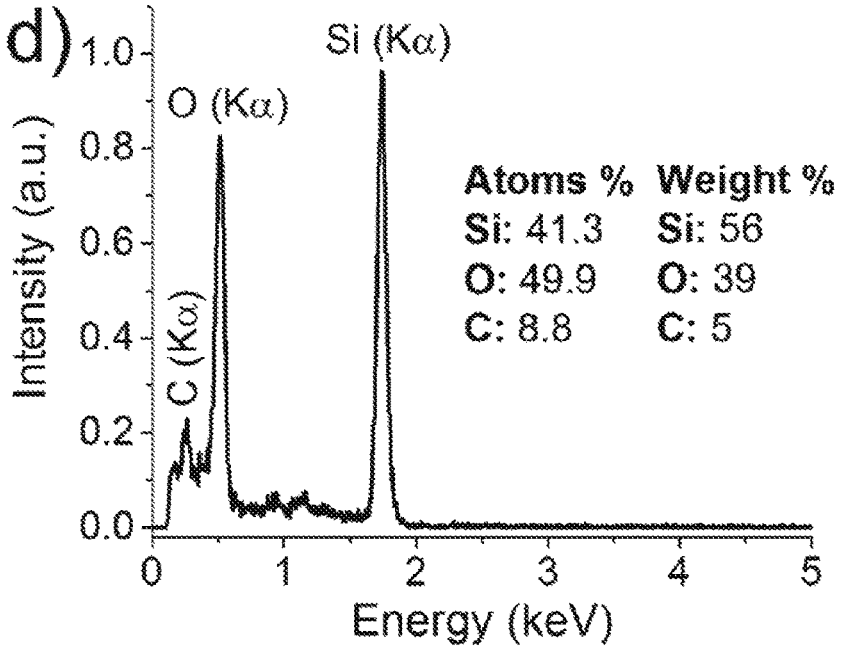
FIG. 13D shows energy-dispersive x-ray spectroscopy (EDXS) data showing the presence of Si, O, and C in embodiments herein.
Figure 14A:
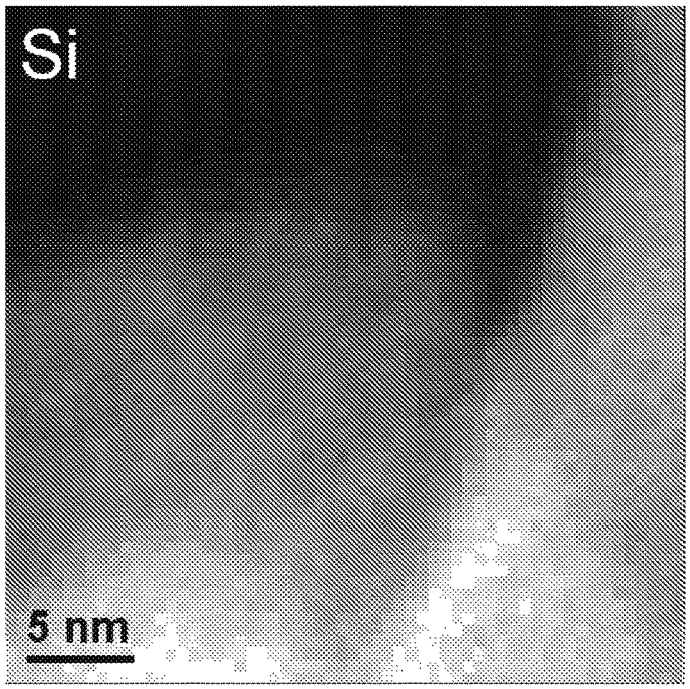
FIGS. 14A, 14B, and 14C are EDXS maps showing homogenous distribution of Si, O, C respectively in embodiments herein.
Figure 14B:
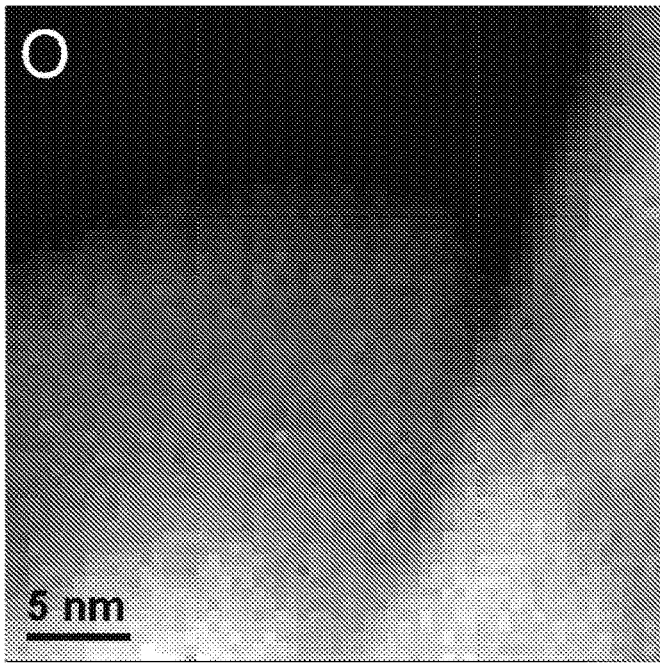
Figure 14C:
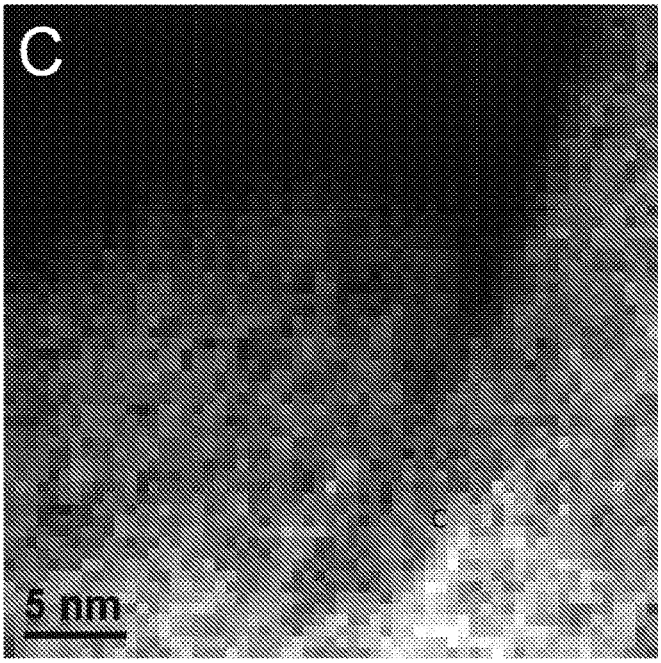
Figure 14D:
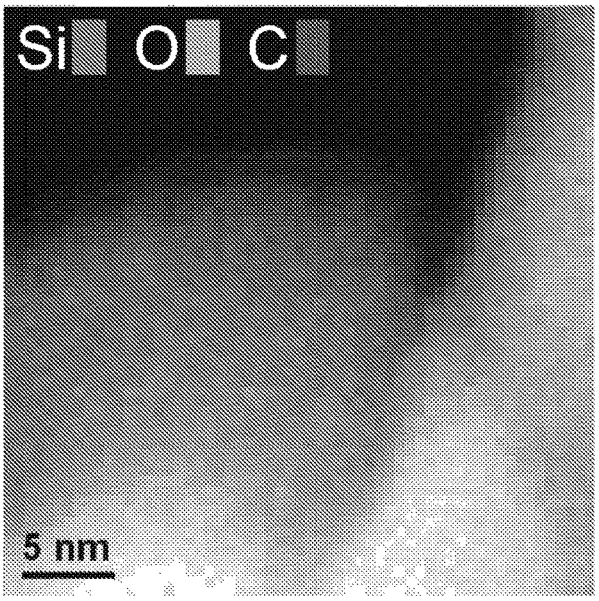
FIG. 14D is a superimposition of FIGS. 14A-14C.

TEM images of nanoparticles at low and high magnification are presented in FIG. 13A and FIG. 13B, respectively. The nanoparticles can be amorphous, as shown by the high-resolution (HR) image (FIG. 13B) and the electron diffraction pattern (inset in FIG. 13B), with an average size of ~30 nm. Moreover, the Electron Energy Loss Spectroscopy (EELS), presented in FIG. 13C, shows the presence of Si, O, and C elements. The Si-associated spectrum is typical silicon oxide EELS spectrum [Ben Romdhane 2013]. The EDXS spectrum (FIG. 13D) also shows the presence of C (Kα), O (Kα), and Si (Kα) with a relative atom percentage of 8.8, 49.9, and 41.3%, respectively.

In addition, to locate the distribution of C, Si, and O, a cartography of these elements was made (FIGS. 14A-14D), which evidences homogeneous distribution of these elements in the nanomaterial.

Characterization of the Heated Nanomaterial (Up to 500° C.)

The control of chemical and microstructural stabilities of SiOC:H material is an important step for practical applications. Usually, to achieve a chemical and physical stable structure or to test a stability of the material, the material is exposed to a 400-500° C. oven for a thermal annealing [Grill 2003, Burkey 2003]. The annealing causes release of hydrogen from $CH_x$ groups and the formation of nano-sized voids, which can give rise to a lower density material, which can result in an additional decrease of the dielectric constant [Maex 2003]. In this light, we processed the samples at 200° C. furnace for 2 hours and another samples for 2 hours at 500° C. Although the temperature gap (from 200 to 500° C.) is large, the time resolved temperature is beyond the scope of work herein.

Figure 15A:
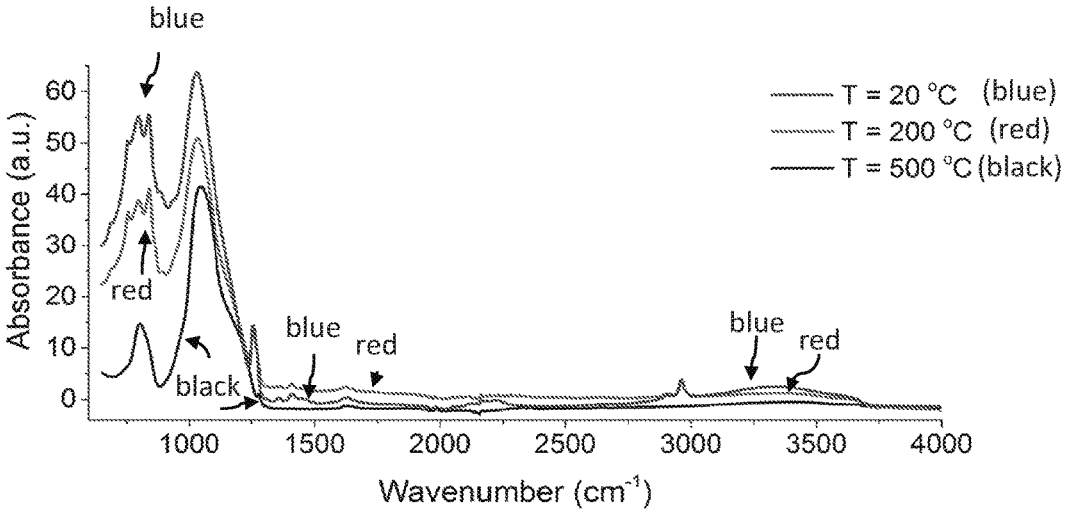
FIG. 15A depicts FT-IR spectra (absorbance) of embodiments of synthesized particles: for 2 hours treatment at 200° C. (red) and for 2 hours treatment at 500° C. (black), and compared with those collected at 20° C. (blue).
Figure 15B:
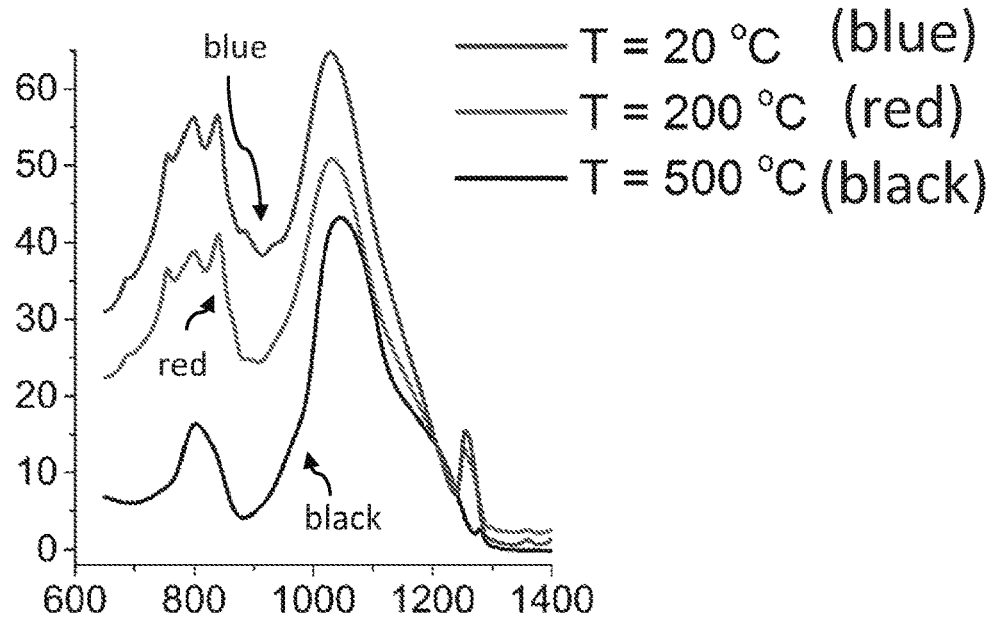
FIG. 15B is a zoomed view from FIG. 15A showing wavenumbers 600-1400 $cm^{-1}$.
Figure 15C:
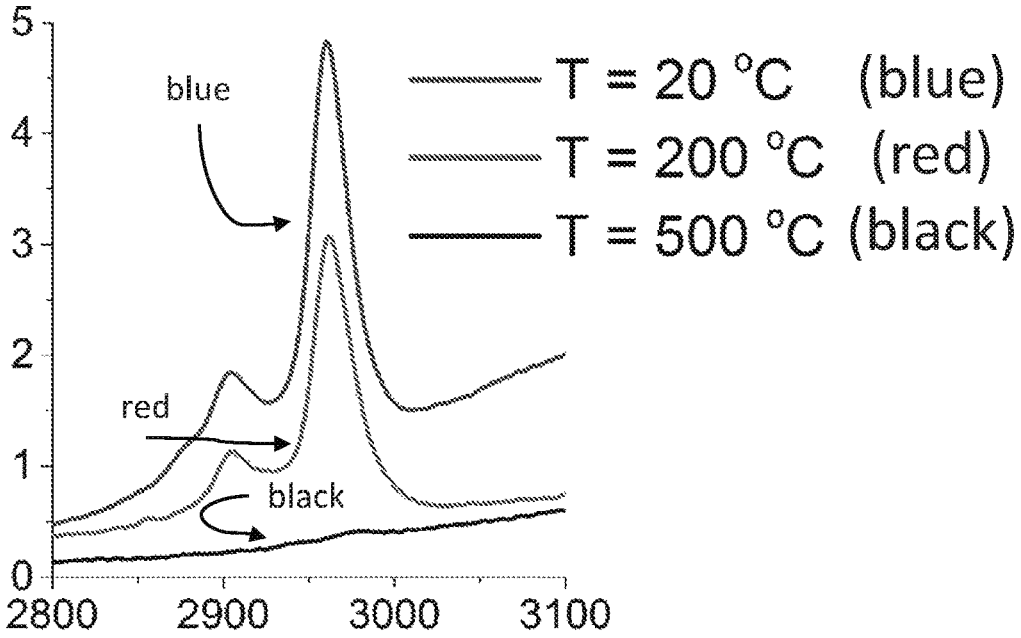
FIG. 15C is a zoomed view from FIG. 15A showing wavenumbers 2800-3100 $cm^{-1}$.

After heat treatment at 200° C., the integrity of the material, as monitored using FT-IR, did not show any significant changes apart from slight decrease in the overall peak intensities (FIGS. 15A-15C). However, significant changes in the FT-IR spectrum were noted for the samples treated at 500° C. In particular, as the treated temperature increases;

i) The multiple peaks of Si—$(CH_3)_{1,2,3}$ from 600 to 900 $cm^{-1}$, observed for the samples treated at 20 and 200° C., were reduced to one broad peak centered at 805 $cm^{-1}$.

ii) The Si—O—Si peak centered at 1060 $cm^{-1}$ moved toward high wavenumber with the appearance of shoulders.

iii) The peaks for the stretching vibration of C—H bond in CH3 (2900-3000 $cm^{-1}$) diminished, and completely disappeared at the treatment temperature of 500° C.

Figure 16A:
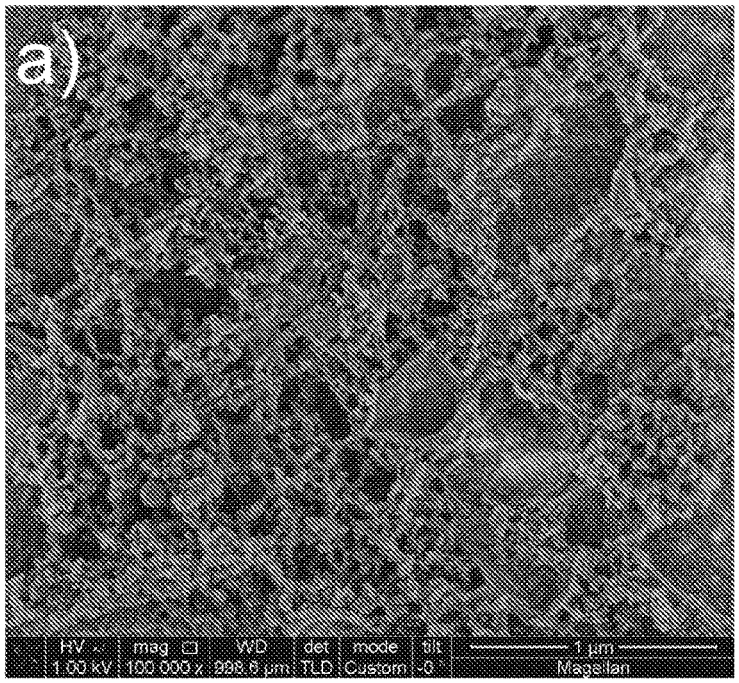
FIGS. 16A and 16B are SEM images showing embodiments of nanoparticles deposited onto an aluminum substrate after thermal treatment at 500° C. for two hours.
Figure 16B:
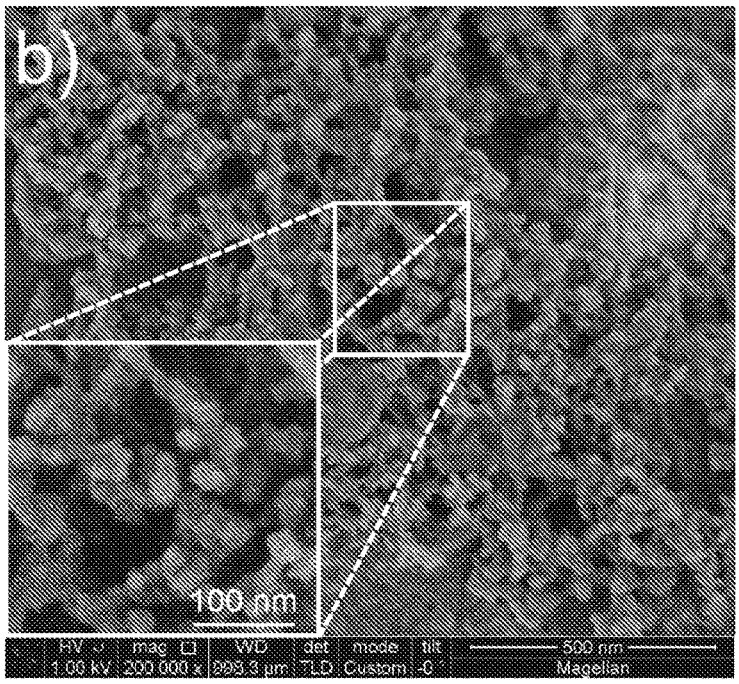

Further SEM characterization was conducted on the nanoparticles treated at 500° C. for 2 hours. Compared to the unheated particles (FIGS. 12A-12D), the thermally treated sample (FIGS. 16A-16B) shows no sheets formed and largely reduced matrix-like structure, while the size of the nanoparticle remains ~30 nm.

Figure 17A:
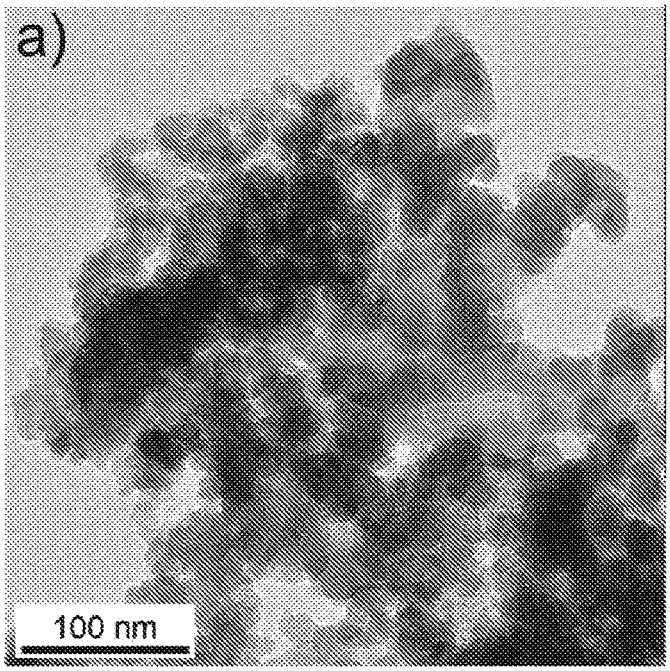
FIG. 17A is a low magnification TEM image of an embodiment of a sample as described herein.
Figure 17B:
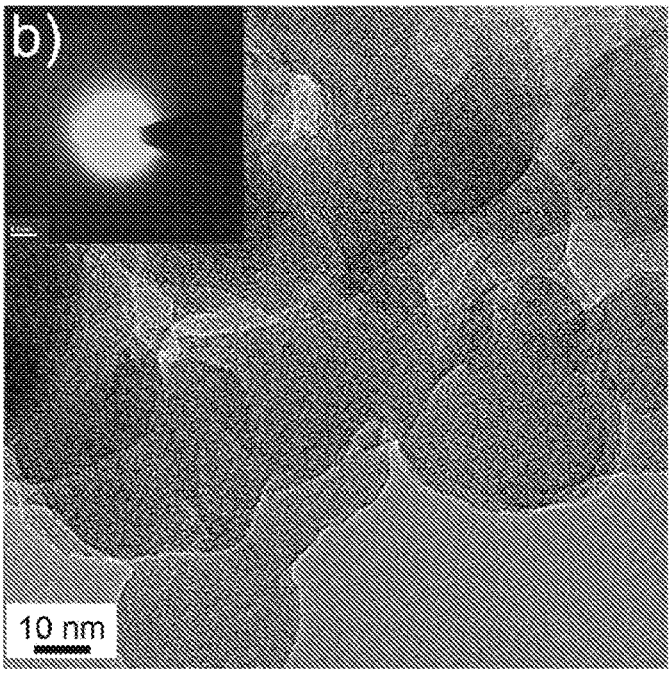
FIG. 17B is a high magnification TEM image of an embodiment of a sample as described herein thermally treated at 500° C. for two hours.
Figure 17C:
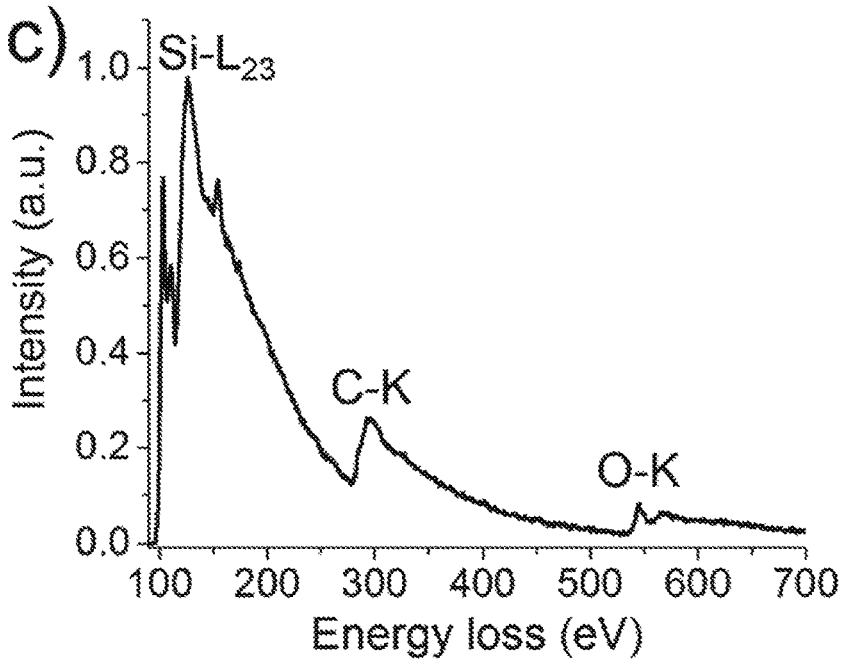
FIG. 17C is an EELS spectra showing the presence of C, O, and Si for an embodiment of a sample thermally treated at 500° C. for two hours.
Figure 17D:
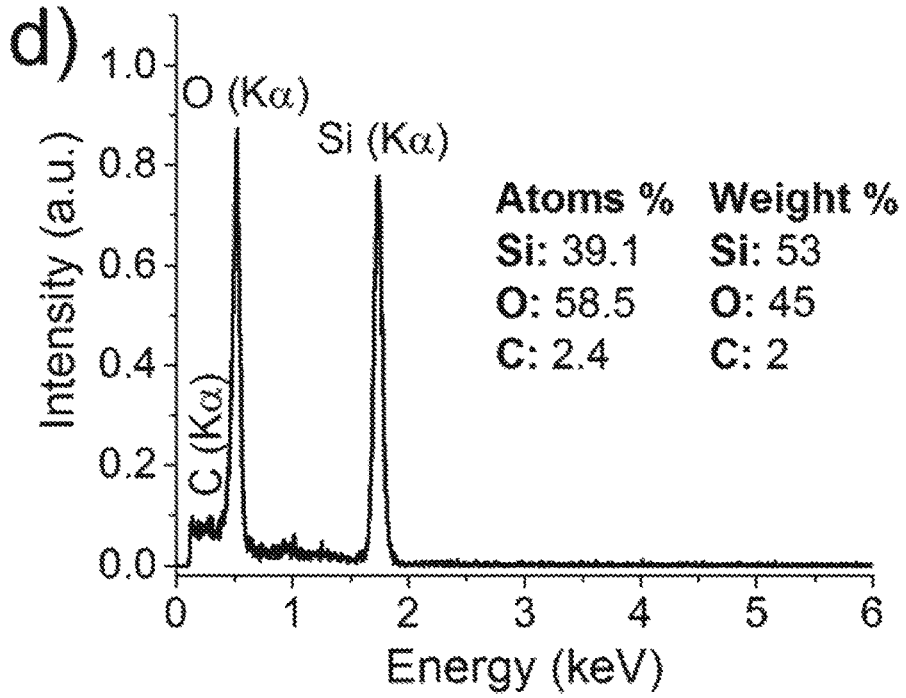
FIG. 17D is an EDXS spectra showing the presence of C, O, and Si for an embodiment of a sample thermally treated at 500° C. for two hours.
Figure 18A:
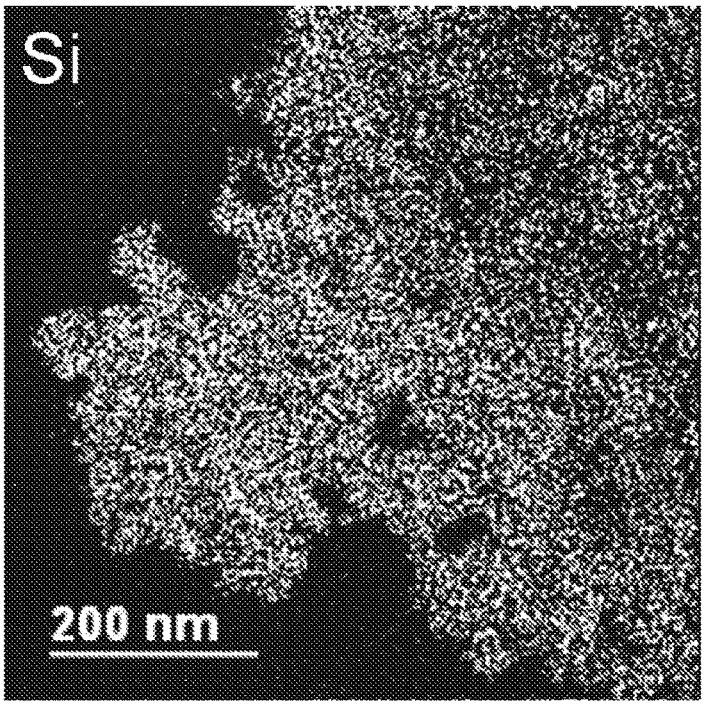
FIGS. 18A-18C show EDXS maps of Si, O, and C respectively for embodiments of nanoparticles heated at 500° C. for 2 hours.
Figure 18B:
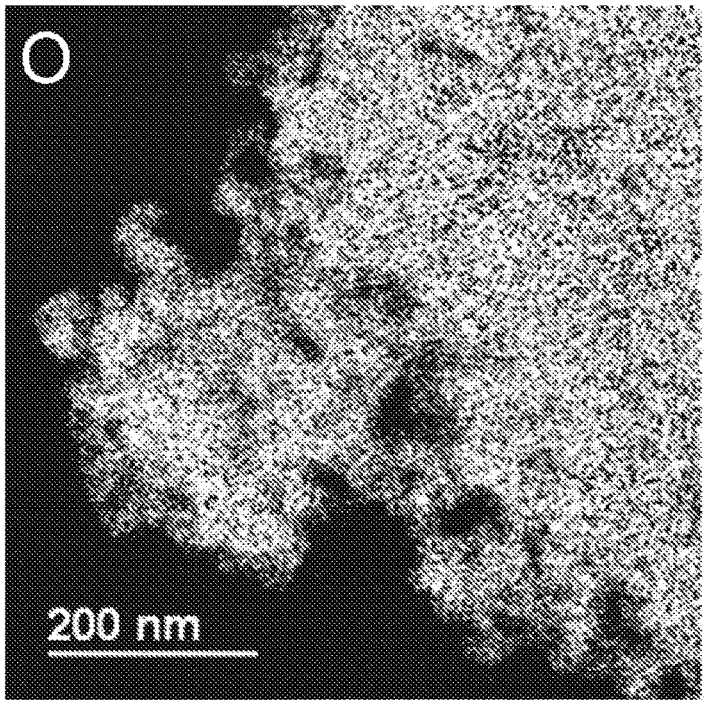
Figure 18C:
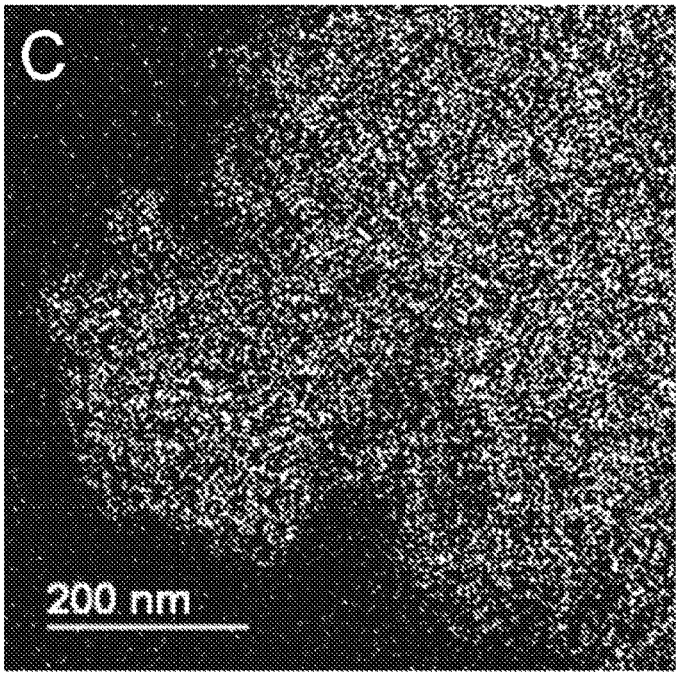
Figure 18D:
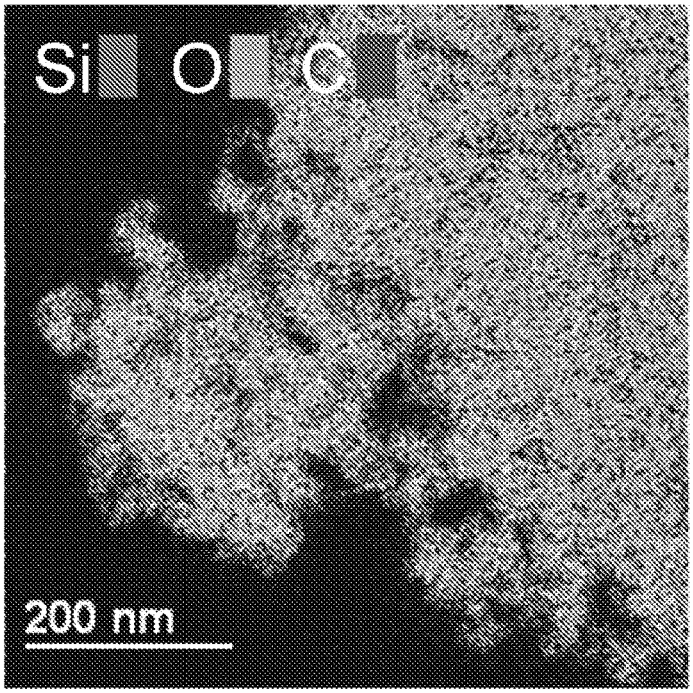
FIG. 18D is a superimposition of FIGS. 18A-18C.

FIGS. 17A and 17B show the morphology of the sample treated at 500° C. for 2 hours using TEM imaging illustrating that agglomerated nanoparticles at low and high magnification can be identified. The electron diffraction pattern, inset in FIG. 17B, can show that the crystallographic phase of the nanoparticles remains amorphous. EELS spectrum (FIG. 17C) is similar to the unheated particles showing the three elements: Si, C, and O elements. EDXS analysis (FIG. 17D) shows a slight change in the relative atom percentage of these elements as 2.4, 58.5, and 39.1% for C, O, and Si, respectively.

FIGS. 18A-18D illustrate the cartography of the main three elements (C, Si, and O). The EDXS map can show a homogeneous distribution of all three elements demonstrating negligible substantial changes compared to the unheated sample.

Figure 19A:
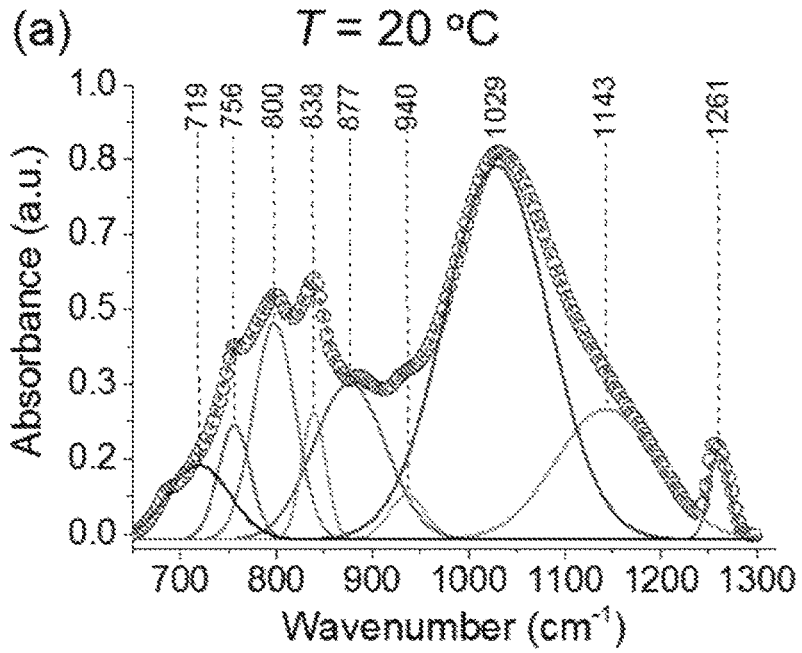
FIG. 19A shows FT-IR spectra (absorbance) of embodiments of synthesized particles dried at 20° C. The circles are the experimental data, the colored peaks are Gaussian profiles and used to fit the experimental spectra, and the dashed line is the sum of the Gaussian profiles.
Figure 19B:
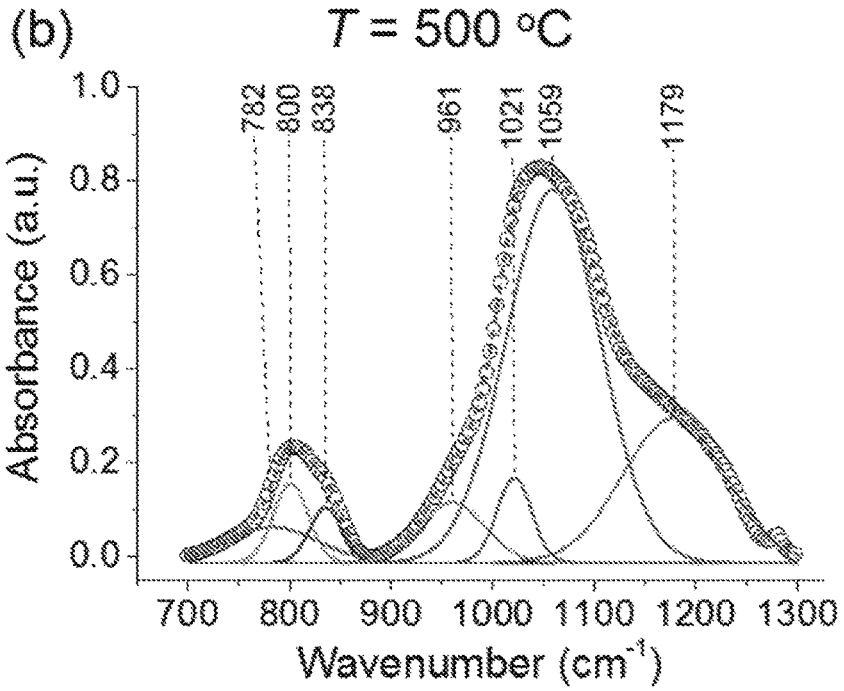
FIG. 19B shows FT-IR spectra (absorbance) of embodiments of synthesized particles thermally treated at 500° C. The circles are the experimental data, the colored peaks are Gaussian profiles and used to fit the experimental spectra, and the dashed line is the sum of the Gaussian profiles.

The deconvolution of the FT-IR peaks is known to provide a better qualitative analysis of the chemical structure of the material. FIGS. 19A-19B present a regression fit of the experimental spectra in a range of 650-1300 $cm^{-1}$ using multiple Gaussian profiles. In the range of 650-900 $cm^{-1}$, five peaks (719, 756, 800, 838, and 877 $cm^{-1}$) were found with the sample dried at T=20° C. (FIG. 19A), which can be associated with different vibrational modes of $Si_x$—$C_y$:H. However, for the sample thermally treated at T=500° C. for 2 hours (FIG. 19B), one broad peak can be fitted by three Gaussian profiles centered at 782, 800, and 838 $cm^{-1}$, respectively, which can be attributed to three SiC stretching vibrational modes. The multi-vibrational modes (multi-peaks) can be associated to disorder in the chemical structure. Indeed, according to Rübel et al. [Rübel 1987], the lowest vibrational energy corresponds to the structure of one carbon atom surrounded by four silicon atoms, while the highest vibrational energy corresponds to the structure of one silicon atom surrounded by four carbon atoms.

In the range of 900-1300 $cm^{-1}$, a dominant absorbance peak in FT-IR spectra for the sample dried at 20° C. was found to be at 1029 $cm^{-1}$, which corresponds to a typical SiOC:H [Das 2004]. However, for the sample thermally treated at 500° C. for 2 hours, the dominant peak was observed at 1059 $cm^{-1}$, which can be attributed to $SiO_2$ [Pai 1986] or to the stretching a smaller angle in Si—O—Si bonds in a network structure [Grill 2003]. Other observed peaks, 940 and 1143 $cm^{-1}$ at T=20° C. and 961, 1021, and 1179 $cm^{-1}$ at T=500° C., can be attributed to different vibrational modes of Si—O—Si with different bond angles [Grill 2003] and/or different percentage of carbon content in the material [Kim 2001]. In addition, the energy of the stretching vibrational mode of Si—O—Si reflects the number of oxygen atoms in the material. For example, in $SiO_x$ compounds the vibrational energy varies linearly from 940 to 1075 $cm^{-1}$ if x varies from 0 (amorphous Si) to 2 ($SiO_2$) [Pai 1986.]. Moreover, two stretching vibrational modes can be distinguished: transverse optic (TO) at ~1045 $cm^{-1}$ and longitudinal optic (LO) at ~1140 $cm^{-1}$ [Aissaoui 2011].

In fact, due to the presence of carbon atoms in the structure, the situation becomes more complex, thus the vibrational energy could not be well defined. It has been reported that in SiOC:H thin films, the vibrational energy of Si—O—Si was found ~1034 $cm^{-1}$ [Das 2004], lower than that reported in $SiO_2$ films, because the electronegativity of carbon (2.5) is relatively low compared to oxygen (3.5). On the other hand, because the percentage of carbon, estimated by EDXS was less than 10% for both cases (T=20 and 500° C.), a line shift from ~1060 (% C=0%) to ~1050 $cm^1$ (%

C=10%) can be expected. This cannot explain either the peak at 940 or at 1143 $cm^{-1}$ of Si—O—Si at T=20° C. However, as suggested by Pai et al. [Pai 1986], the peak at 940 $cm^{-1}$ is more likely attributed to amorphous silicon, while, a ssuggested by Grill et al. [Grill 2003], the peak at 1143 $cm^{-1}$ is attributed to a larger angle of Si—O—Si bonds in a cage structure with a bond angle of approximately 150°. In the case of the material treated at 500° C., the peak at 961 $cm^{-1}$ can be attributed to the vibration of Si—O—Si in amorphous silicon doped oxygen (i.e., $SiO_x$, where x=0.5) [Pai 1986], the peak at 1021 $cm^{-1}$ can be attributed to the vibration of Si—O—Si in SiOC:H [Das 2004], and the peak at 1179 $cm^{-1}$ can be also attributed to Si—O—Si of larger angle bonds in a cage structure. By comparing the relative area of those peaks, we may deduce that the contribution of the Si—O— Si in SiOC:H structure is strongly reduced after thermal treatment, which supports our discussion regarding the disappearing of the C—H in $CH_3$ bonds due to evaporation of volatile compounds, such as hydrogenated carbons.

Figure 20:
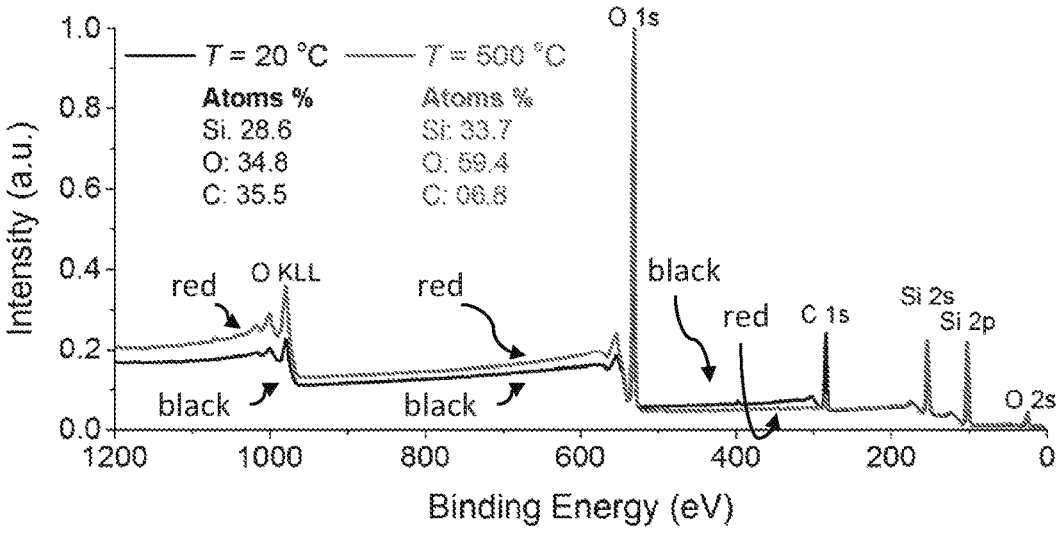
FIG. 20 shows x-ray photoelectron spectroscopy (XPS) data of embodiments of the synthesized particles dried at 20° C. (black) and after thermal treatment at 500° C. for two hours (red).

To have a better understanding of the chemical bonds in the material, XPS analysis was conducted on the synthesized materials. The full range XPS spectra, FIG. 20, can show Si, O, and C with relative atom percentage of 28.6, 34.8, and 35.5%, respectively, for the material dried at 20° C., and 33.7, 59.4, and 6.8%, respectively, after thermal treatment at 500° C. for 2 hours. The qualitative variation in percentile atomic distribution is similar to that observed through the EDXS analysis; however, the percentage of carbon estimated by XPS is relatively higher than that estimated by EDXS. For instance, the percentages of carbon by XPS can be 35.5 and 6.8% at T=20° C. and 500° C., respectively, while those obtained by EDXS are 8.8 and 2.4%. This difference can be attributed to the sensitivity of each technique, where the penetration depth of XPS technique is about several nanometers, while it is around several micrometers for FT-IR technique (EDXS).

Figure 21A:
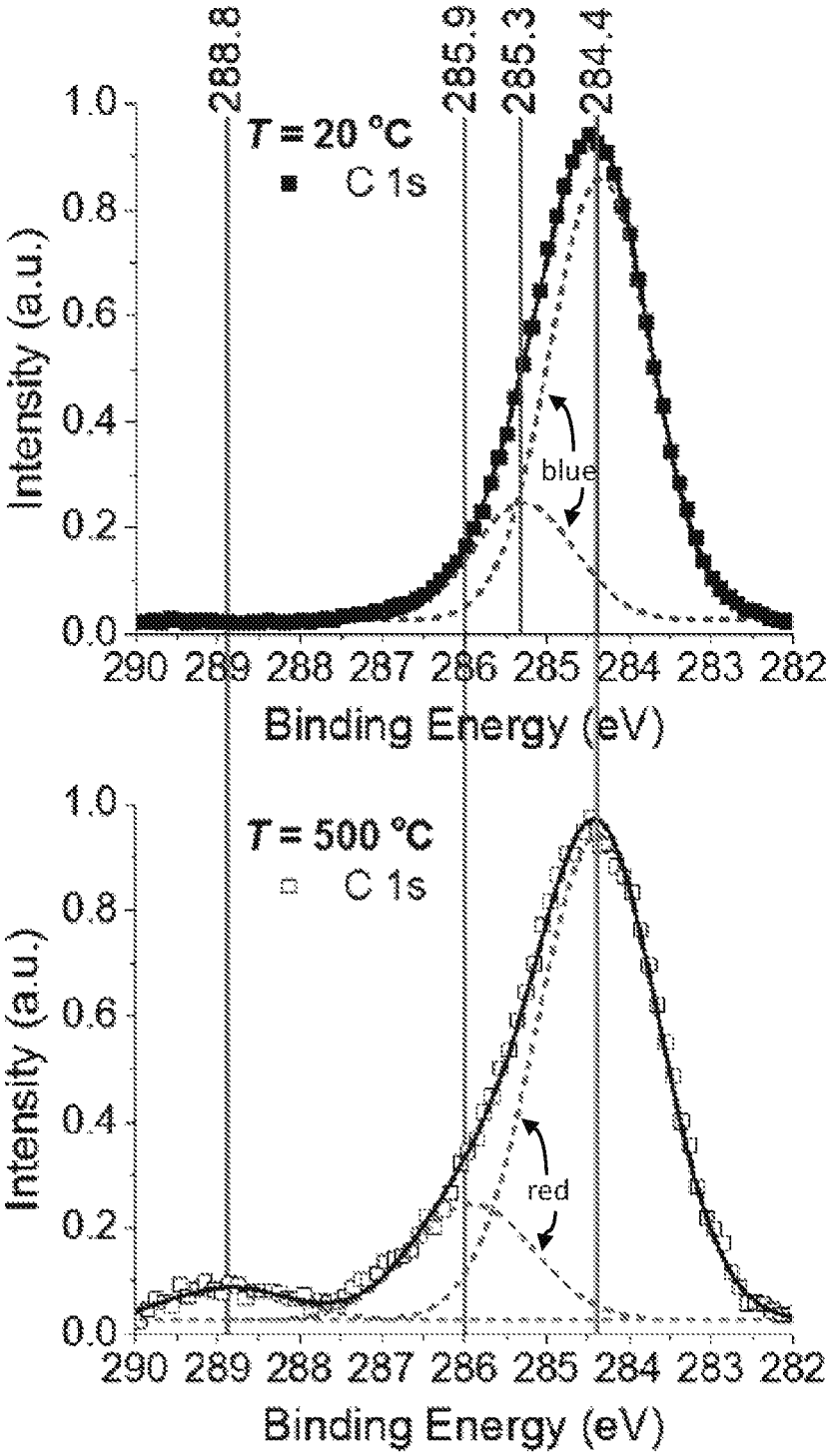
FIGS. 21A-21C are high-resolution XPS spectra of embodiments of the synthesized solid particles dried at 20° C. (filled square) and after thermal treatment at 500° C. for two hours (empty square). The dotted lines (blue at 20° C. and red at 500° C.) are elementary Gaussian profiles and the black solid lines are the superimposed overall fitting lines for the experimental data.
Figure 21B:
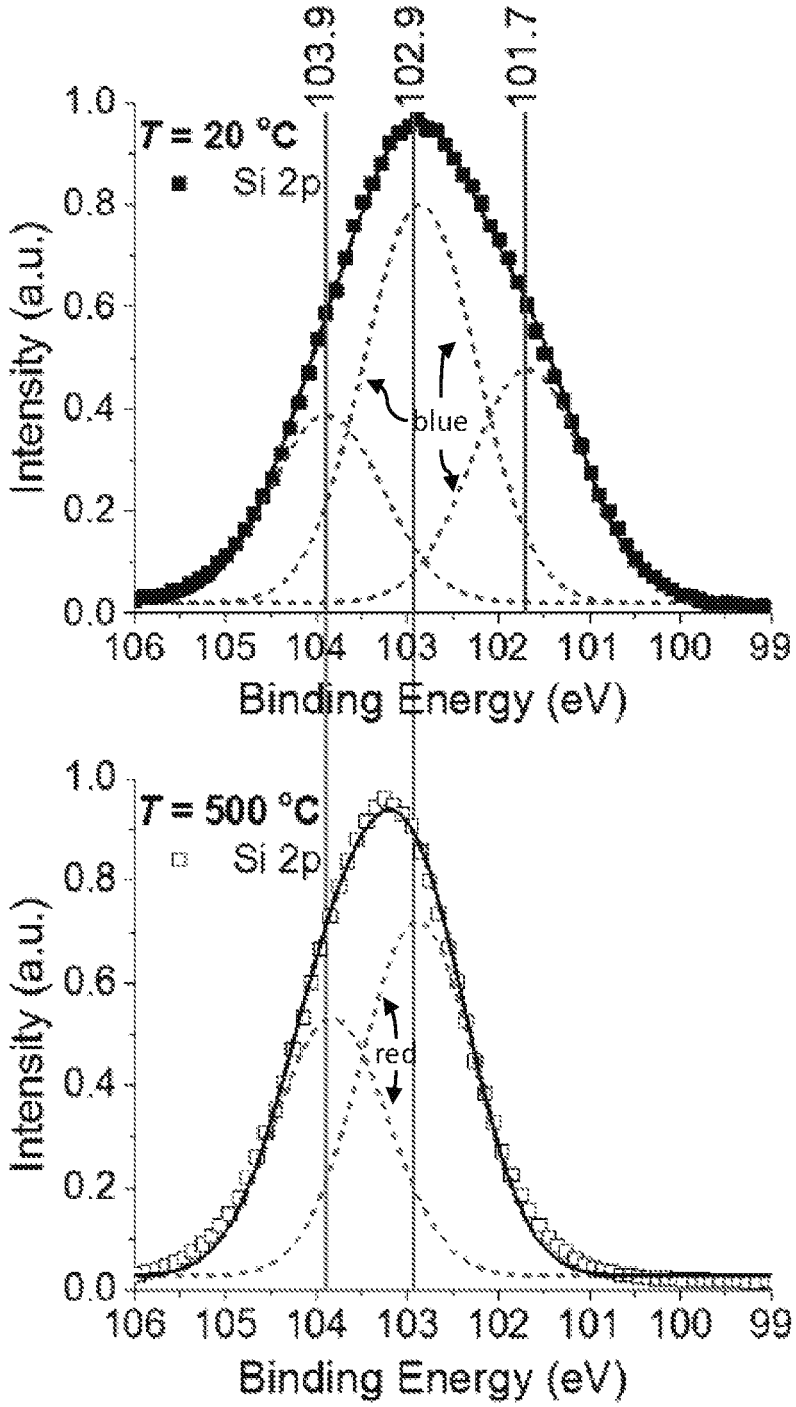
Figure 21C:
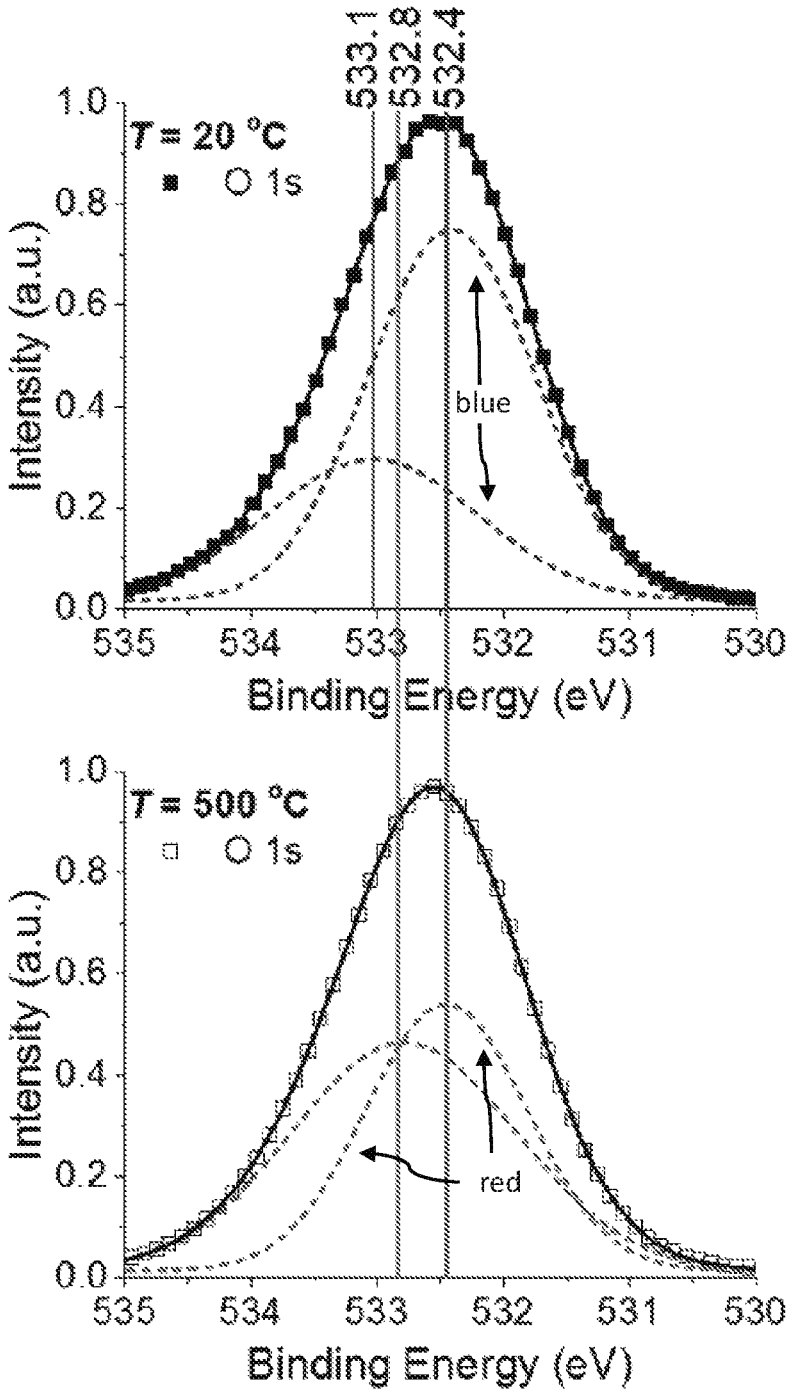

To estimate the viable bonds that can be presented between C, Si, and O, the high-resolution XPS spectra of C 1s, Si 2p, and O 1s were fitted using multiple Gaussian profiles as presented in FIGS. 21A-21C. As a result, the identified peaks and their corresponding bonds are summarized in FIG. 22. Note that due to a relatively shallow penetration depth of this technique, the extracted information reflects only the surface of the material. However, the FT-IR provides better insight for a volumetric information, as discussed previously.

Concerning C 1s, the dominant peak, at 284.4 eV, is observed for both temperatures, and this energy can be assigned to amorphous carbon atoms (am-C) [Lascovich 1991]. At T=20° C., a peak at 285.3 eV reflecting C in hydrocarbons [Moncoffre 1985] was observed. Meanwhile, at T=500° C., the appearance of peaks at 285.9 and 288.8 eV was observed, and these peaks can correspond to C═O [Mårtensson 1990, Olsson 1994]. This can be explained that as upon the thermal treatment in air, the unsaturated carbon atoms are bonded to O atoms while hydrocarbons evaporate.

For the Si 2p peaks, dominant elementary peaks were found at 102.9 eV for both temperatures, and it can be assigned to SiO in SiC [Contarini 1991] and/or $SiO_2C_2$ [Sorarù 1996]. Other peaks at 103.9 eV were also identified for both temperatures, which can be assigned to $SiO_3C$ [Sorarù 1996]. Note that, a peak at 101.7 eV was observed only at T=20° C., which can be attributed to $SiCO_3$ [Sorarù 1996].

In case of O 1s analysis, the peaks at 532.4 eV, corresponding to Si—O—Si [Bertoti 1988], were found for both temperatures. At T=20° C., the peak at 533.1 eV can be assigned to C—OH [Gardner 1995], while at T=500° C., the peak at 532.8 eV can be assigned to C—O—C [Gardner 1995]. This result can be attributed to the conversion of C—OH bonds to C—O—C after the thermal treatment in air at 500° C.

These results show that information extracted from XPS analysis are qualitatively in good agreement with FTIR analysis to describe the chemical structure of the material at T=20° C. and T=500° C. As the HR-TEM results have also shown, the synthesized material dried at 20° C., indicated a kind of homogeneous alloy of Si, C, O, and H, i.e., SiOC:H. Meanwhile, after the thermal treatment at 500° C. for 2 hours, the volatile hydrogen-based components disappeared as shown by FTIR (FIGS. 15A-15C) and XPS (FIG. 20) results, and the material became SiOC, which can be a typical material having a low dielectric constant. Other studies on SiOC:H thin films [Das 2004, Das 2006] have shown that a thermal treatment of those films at high temperatures (over 800° C.), has resulted in the disappearance of the C—H bonds. As compared to the present study (500° C.), the difference in the reported temperatures from which the C—H bonds are disappeared can be due to the size of each synthesized material. The specific surface area (per volume) for the present study (nanoparticles) can be much higher than that obtained in a thin film as in Das's studies [Das 2004, Das 2006], allowing an augmented surface reaction even in a lower temperatures.

CONCLUSION

A novel method for the synthesis of SiOC:H nanomaterial is provided herein, for example SiOC:H nanoparticles. This technique can be based on the electrical discharge at the interface of two dielectric liquids: water and HMDSN. The difference of the dielectric permittivity of these liquids (80 for water vs. 2 for HMDSN) can enhance the electric field at the interface leading to increase the discharge efficiency and the production rate of material synthesis. The synthesized nanoparticles can originate from the agglomeration of reactive species created by plasma-induced liquids dissociation, and the final composition can be hydrogenated SiOC. These materials can exhibit structural stability as they were underwent through the thermal treatment at 500° C. for 2 hours. Thus, they can be used for high-temperature microelectronics or other applications where the structural stability of low dielectric constant materials under a high temperature environment can be required. In addition, the erosion of electrode could be avoided, because no tungsten particles could be found in the collected materials. This implies that a high purity nanomaterial can be produced, and the durability of the device can be maximized.

REFERENCES

[Gallis 2009] S. Gallis, V. Nikas, E. Eisenbraun, M. Huang, and A. E. Kaloyeros, "On the Effects of Thermal Treatment on the Composition, Structure, Morphology, and Optical Properties of Hydrogenated Amorphous Silicon Oxycarbide," J. Mater. Res., 24 [08] 2561-73 (2009).

[Moysan 2007] C. Moysan, R. Riedel, R. Harshe, T. Rouxel, and F. Augereau, "Mechanical Characterization of a Polysiloxane-Derived SiOC Glass," J. Eur. Ceram. Soc., 27 [1] 397-403 (2007).

[Du 2012] P. Du, X. Wang, I. K. Lin, and X. Zhang, "Effects of Composition and Thermal Annealing on the Mechanical Properties of Silicon Oxycarbide Films," Sens. Actuat. A Phys., 176, 90-8 (2012).

[Nastasi 2015]M. Nastasi, Q. Su, L. Price, J. A. Colón Santana, T. Chen, et al., "Superior Radiation Tolerant Materials: Amorphous Silicon Oxycarbide," J. Nucl. Mater., 461, 200-5 (2015).

[Zhuo 2005] R. Zhuo, P. Colombo, C. Pantano, and E. A. Vogler, "Silicon Oxycarbide Glasses for Blood-Contact Applications," Acta Biomater., 1 [5] 583-9 (2005).

[Hamdan 2016] A Hamdan and M S Cha 2016

[Kruis 1998] Kruis, F. Einar, Heinz Fissan, and Aaron Peled. "Synthesis of nanopartidcles in the gas phase for electronic, optical and magnetic applications—a review." Journal of Aerosol Science 29.5 (1998): 511-535.

[Richmonds 2008] Richmonds, Carolyn, and R. Mohan Sankaran. "Plasma-liquid electrochemistry: rapid synthesis of colloidal metal nanoparticles by microplasma reduction of aqueous cations." Applied Physics Letters 93.13 (2008): 131501.

[Sankaran 2005] Sankaran, R. M., Holunga, D., Flagan, R. C., & Giapis, K. P. (2005). Synthesis of blue luminescent Si nanoparticles using atmospheric-pressure microdischarges. Nano letters, 5(3), 537-541.

[Mariotti 2010] Mariotti, Davide, and R. Mohan Sankaran. "Microplasmas for nanomaterials synthesis." Journal of Physics D: Applied Physics 43.32 (2010): 323001.

[Belmonte 2014] Belmonte, T., et al. "Interaction of discharges with electrode surfaces in dielectric liquids: application to nanoparticle synthesis." Journal of Physics D: Applied Physics 47.22 (2014): 224016.

[Janiak 2013] Janiak, Christoph. "Metal nanoparticle synthesis in ionic liquids." Ionic Liquids (ILs) in Organometallic Catalysis. Springer Berlin Heidelberg, 2013, 17-53.

[Yonezawa 2010] Yonezawa, Tetsu, et al. "Preparation of zinc oxide nanoparticles by using microwave-induced plasma in liquid." Chemistry Letters 39.7 (2010): 783-785.

[Fanelli 2014] Fanelli, F., & Fracassi, F. (2014). Aerosol-Assisted Atmospheric Pressure Cold Plasma Deposition of Organic-Inorganic Nanocomposite Coatings. Plasma Chemistry and Plasma Processing, 34(3), 473-487.

[Fauchais 2008] Fauchais, P., Etchart-Salas, R., Rat, V., Coudert, J. F., Caron, N., & Wittmann-Ténèze, K. (2008). Parameters controlling liquid plasma spraying: Solutions, sols, or suspensions. Journal of Thermal Spray Technology, 17(1), 31-59.

[Hamdan 2014] Hamdan. A., Noël, C., Ghanbaja, J., & Belmonte, T. (2014). Comparison of aluminium nanostructures created by discharges in various dielectric liquids. Plasma Chemistry and Plasma Processing, 34(5), 1101-1114.

[Kabbara 2015] Kabbara, H., Noël, C., Ghanbaja, J., Hussein, K., Mariotti, D., Švrček, V., & Belmonte, T. (2015). Synthesis of nanocrystals by discharges in liquid nitrogen from Si—Sn sintered electrode. Scientific reports, 5.

[Hamdan 2013a] Hamdan, A., Noël, C., Ghanbaja, J., Migot-Choux, S., & Belmonte, T. (2013). Synthesis of platinum embedded in amorphous carbon by micro-gap discharge in heptane. Materials Chemistry and Physics, 142(1), 199-206.

[Sano 2004] Sano, N. (2004). Formation of multi-shelled carbon nanoparticles by arc discharge in liquid benzene. Materials chemistry and physics, 88(2), 235-238.

[Graham 2011] Graham, W. G., and K. R. Stalder. "Plasmas in liquids and some of their applications in nanoscience." Journal of Physics D: Applied Physics 44.17 (2011): 174037.

[Hamdan 2013b] Hamdan, A., et al. "Dynamics of bubbles created by plasma in heptane for micro-gap conditions." The Journal of the Acoustical Society of America 134.2 (2013): 991-1000.

[Sato 2011] Sato, S., Mori, K., Ariyada, O., Atsushi, H., & Yonezawa, T. (2011). Synthesis of nanoparticles of silver and platinum by microwave-induced plasma in liquid. Surface and Coatings Technology, 206(5), 955-958.

[Maex 2003] Maex, K., Baklanov, M. R., Shamiryan, D., Brongersma, S. H., & Yanovitskaya, Z. S. (2003). Low dielectric constant materials for microelectronics. Journal of Applied Physics, 93(11), 8793-8841.

[Seong 2004] Seong H K, Choi H J, Lee S K, Lee J I and Choi D J 2004 Optical and electrical transport properties in silicon carbide nanowires Appl. Phys. Lett. 85 1256

[Zhou 2006] Zhou W, Liu X and Zhang Y 2006 Simple approach to β-SiC nanowires: synthesis, optical, and electrical properties Appl. Phys. Lett. 89 223124

[Wong 1999] Wong K W, Zhou X T, Au F C K, Lai H L, Lee C S and Lee S T 1999 Field-emission characteristics of SiC nanowires prepared by chemical-vapor deposition Appl. Phys. Lett. 75 2918

[Zhang 2010] Zhang, X., Huang, X., Wen, G., Geng, X., Zhu, J., Zhang, T., & Bai, H. (2010). Novel SiOC nanocomposites for high-yield preparation of ultra-large-scale SiC nanowires. Nanotechnology, 21(38), 385601.

[Ben Romdhane 2013] Ben Romdhane, F., Björkman, T., Rodriguez-Manzo, J. A., Cretu, O., Krasheninnikov, A. V. and Banhart, F., 2013. In situ growth of cellular two-dimensional silicon oxide on metal substrates. ACS nano, 7(6), pp. 5175-5180.

[Das 2004] Das, G., G. Mariotto, and A. Quaranta. "Vibrational spectroscopy characterization of low-dielectric constant SiOC:H films prepared by PECVD technique." Materials science in semiconductor processing 7.4 (2004): 295-300.

[Rübel 1987] Rübel, H., Schröder, B., Fuhs, W., Krauskopf, J., Rupp, T. and Bethge, K., 1987. IR Spectroscopy and Structure of RF Magnetron Sputtered a-SiC:H Films. physica status solidi (b), 139(1), pp. 131-143.

[Pai 1986] Pai, P. G., Chao, S. S., Takagi, Y. and Lucovsky, G., 1986. Infrared spectroscopic study of SiOx films produced by plasma enhanced chemical vapor deposition. Journal of Vacuum Science & Technology A, 4(3), pp. 689-694.

[Aissaoui 2011] Aissaoui, N., Bergaoui, L., Landoulsi, J., Lambert, J. F. and Boujday, S., 2011. Silane layers on silicon surfaces: mechanism of interaction, stability, and influence on protein adsorption. Langmuir, 28(1), pp. 656-665.

[Grill 2003] Grill, A. and Neumayer, D. A., 2003. Structure of low dielectric constant to extreme low dielectric constant SiCOH films: Fourier transform infrared spectroscopy characterization. Journal of Applied Physics, 94(10), pp. 6697-6707.

[Kim 2001] Kim, Y. H., Hwang, M. S., Kim, H. J., Kim, J. Y. and Lee, Y., 2001. Infrared spectroscopy study of low-dielectric-constant fluorine-incorporated and carbon-incorporated silicon oxide films. Journal of Applied Physics, 90(7), pp. 3367-3370.

[Lascovich 1991] Lascovich, J. C., R. Giorgi, and S. Scaglione. "Evaluation of the sp 2/sp3 ratio in amorphous carbon structure by XPS and XAES." Applied Surface Science 47.1 (1991): 17-21.

[Moncoffre 1985] Moncoffre, N., Hollinger. G., Jaffrezic, H., Marest, G. and Tousset, J., 1985. Temperature influence during nitrogen implantation into steel. Nuclear Instruments and Methods in Physics Research Section B: Beam Interactions with Materials and Atoms, 7. pp. 177-183.

[Mårtensson 1990] Mårtensson, Nils, and Anders Nilsson. "Core-Level line shapes of adsorbates: effects of electronic and vibrational excitations." Journal of Electron Spectroscopy and Related Phenomena 52 (1990): 1-46

[Olsson 1994] Olsson, C. O. A. and Hörnström, S. E., 1994. An AES and XPS study of the high alloy austenitic stainless steel 254 SMO® tested in a ferric chloride solution. Corrosion science, 36(1), pp. 141-151.

[Carriere 1977] Carriere, B., Deville, J. P., Brion, D. and Escard, J., 1977. X-ray photoelectron study of some silicon-oxygen compounds. Journal of Electron Spectroscopy and Related Phenomena, 10(2), pp. 85-91.

[Sorarù 1996] Sorarù, G. D., D'Andrea, G. and Glisenti, A., 1996. XPS characterization of gel-derived silicon oxycarbide glasses. Materials Letters, 27(1), pp. 1-5.

[Contarini 1991] Contarini, S., Howlett, S. P., Rizzo, C., & De Angelis, B. A. (1991). XPS study on the dispersion of carbon additives in silicon carbide powders. Applied surface science, 51(3), 177-183

[Bertoti 1988] Bertoti, I., Varsányi, G., Mink, G., Szekely, T., Vaivads, J., Millers, T. and Grabis, J., 1988. XPS characterization of ultrafine Si3N4 powders. Surface and Interface Analysis, 12(10), pp. 527-530.

[Gardner 1995] Gardner, S. D., Singamsetty, C. S., Booth, G. L., He, G. R. and Pittman, C. U., 1995. Surface characterization of carbon fibers using angle-resolved XPS and ISS. Carbon, 33(5), pp. 587-595.

[Das 2006] Das, G., Mariotto, G. and Quaranta, A., 2006. Microstructural evolution of thermally treated low-dielectric constant SiOC:H films prepared by PECVD. Journal of The Electrochemical Society, 153(3), pp. F46-F51.

[Lee 1998] Lee, S. H. and Lee, D. C., 1998. Preparation and characterization of thin films by plasma polymerization of hexamethyldisiloxane. Thin Solid Films, 325(1), pp. 83-86.

[Gates 2007] Gates, S. M., Neumayer, D. A., Sherwood, M. H., Grill, A., Wang, X. and Sankarapandian, M., 2007. Preparation and structure of porous dielectrics by plasma enhanced chemical vapor deposition. Journal of applied physics. 101(9).

[Kim 1997] Kim, M. T. and Lee, J., 1997. Characterization of amorphous SiC:H films deposited from hexamethyldisilazane. Thin Solid Films, 303(1), pp. 173-179.

[Park 1990] Park, S. Y., Kim, N., Kim, U. Y., Hong, S. I. and Sasabe, H., 1990. Plasma polymerization of hexamethyldisilazane. Polymer Journal, 22(3), pp. 242-249

[Bashir 2015] Bashir, M. and Bashir, S., 2015. Hydrophobic-hydrophilic character of hexamethyldisiloxane films polymerized by atmospheric pressure plasma jet. Plasma Chemistry and Plasma Processing, 35(4), pp. 739-755. S. H. Lee, D. C. Lee/Thin Solid Films 325 (1998) 83-86

[Gates 2007] S. M. Gates, D. A. Neumayer, M. H. Sherwood, A. Grill, X. Wang, and M. Sankarapandian, Preparation and structure of porous dielectrics by plasma enhanced chemical vapor deposition Journal of Applied Physics 101, 094103 (2007) [Grill 2003] A. Grill and D. A. Neumayer, J. Appl. Phys., 94, 6697 (2003). [Burkey 2003]D. D. Burkey and K. K. Gleason, J. Appl. Phys., 93, 5143 (2003).

[Maex 2003] K. Maex, M. R. Baklanov, D. Shamiryan, F. Iacopi, S. H. Brongersma, and Z. S. Yanovitskaya, J. Appl. Phys., 93, 8793 (2003)]

[Richmonds 2008] Richmonds, Carolyn, and R. Mohan Sankaran. "Plasma-liquid electrochemistry: rapid synthesis of colloidal metal nanoparticles by microplasma reduction of aqueous cations." Applied Physics Letters 93.13 (2008): 131501.

[Askari 2014] Askari, S.; Levchenko, I.; Ostrikov, K.; Maguire, P.; Mariotti, D. Crystalline Si Nanoparticles below Crystallization Threshold: Effects of Collisional Heating in Nonthermal Atmospheric-Pressure Microplasmas. Appl. Phys. Lett. 2014, 104 (16), 163103

[Muntean 2016] Muntean, Alex, et al. "Generation of copper, nickel, and CuNi alloy nanoparticles by spark discharge." Journal of Nanoparticle Research 18.8 (2016): 229.

Ratios, concentrations, amounts, and other numerical data may be expressed in a range format. It is to be understood that such a range format is used for convenience and brevity, and should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1% to about 5%, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figure of the numerical value. In addition, the phrase "about 'x' to 'y'" includes "about 'x' to about 'y'".

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Therefore, the following is claimed:

1. A device for generating a plasma in a liquid, the device comprising a container configured to hold the liquid, a low-dielectric constant material configured to form an interface with the liquid in the container, an anode configured to extend throughout the low-dielectric constant material and having a first end configured to be in direct contact with the liquid when in the container, and a cathode configured to contact the liquid when in the container;

wherein the cathode and the first end of the anode are separated by a distance of 1.0 mm to 10.0 mm, and wherein the anode and the low-dielectric constant material are configured such that the interface is separated from the first end of the anode by a distance of 0.0 mm to 4.0 mm, and wherein the device is configured to, generate the plasma at the interface to create an interface layer by applying a high voltage to the anode and the cathode with a power source for a first period of time, allow the container to rest for a second period of time, during which the interface layer forms at the interface, and isolate the interface layer from the container.

2. The device of claim 1, wherein the interface is separated from the first end of the anode by a distance of 0.2 mm to 1.0 mm.

3. The device of claim 1, wherein the cathode and the first end of the anode are separated by a distance of 2.0 mm to 3.0 mm.

4. The device of claim 1, wherein the low-dielectric constant material has a dielectric constant of 1 to 10.

5. The device of claim 1, wherein the low-dielectric constant material is a solid, including one of $Al_2O_3$, $BaF_2$, $CaF_2$, $SrF_2$, polyethylene, polyvinyl chloride, and Teflon.

6. The device of claim 1, wherein the low-dielectric constant material is a liquid, including one of n-heptane, cyclohexane, and toluene.

7. The device of claim 1, wherein the low-dielectric constant material is a gas, including one of argon, helium, oxygen, carbon dioxide, nitrogen, and air.

8. The device of claim 1, wherein the container is configured such that the liquid can pass through the container for continuous operation.

9. The device of claim 1, comprising a plurality of the anodes and the cathodes forming from 2 to 8 anode-cathode pairs.

10. The device of claim 1, wherein the container comprises a metal wall and the cathode is the metal wall.

11. The device of claim 1, further comprising:

a ground source electronically coupled to the cathode; and a high-voltage power supply coupled to the anode.

12. The device of claim 11, wherein the high-voltage power supply is a pulsed power supply with an amplitude of 10 kV to 20 kV, a pulse width of 5 ns to 1000 ns, and an operating frequency of 1 Hz to 1000 Hz.

13. A method of producing a plasma in a liquid held in a container, the method comprising:

contacting the liquid with a low-dielectric constant material at an interface, submerging a first end of an anode in the liquid so that the anode extends throughout the low-dielectric constant material and the first end is in direct contact with the liquid, wherein the first end of the anode is separated from the interface by a distance of 0.0 mm to 4.0 mm, contacting a cathode to the liquid, applying for a first period of time a voltage to the anode and cathode to generate the plasma in the liquid, at the interface, to create an interface layer, allowing the container to rest for a second period of time, during which the interface layer forms at the interface, and isolating the interface layer from the container.

14. The method of claim 13, wherein the liquid is water and the method includes water treatment or remediation, or the liquid comprises a hydrocarbon and the method includes hydrocarbon reformation, or the liquid comprises a precursor and the method includes nanomaterial synthesis.

15. The method of claim 13, wherein the liquid comprises a hydrocarbon and the method includes hydrocarbon reformation.

16. The method of claim 13, wherein the liquid comprises a precursor and the method includes nanomaterial synthesis.

17. A method of nanomaterial synthesis, comprising:

providing a container, wherein the container is configured to hold a plurality of immiscible dielectric liquids, wherein the plurality of dielectric liquids comprises a first liquid and a second liquid, wherein the first liquid and the second liquid are immiscible forming an interface between the first liquid and the second liquid;

the container comprises one or more anode and cathode pairs, wherein the one or more anode and cathode pairs respectively are immersed in the plurality of immiscible dielectric liquids, an anode of a anode and cathode pair immersed on a side of the interface opposite the cathode, wherein the one or more anode and cathode pairs are in electric communication with a power source;

generating a plasma at the interface to create an interface layer by applying a high voltage to the anode(s) of the one or more anode and cathode pairs with the power source for a first period of time;

allowing the container to rest for a second period of time, during which an interface layer forms at the interface;

isolating the interface layer from the container;

drying the interface layer at a temperature for a third period of time thereby forming the nanomaterial.

18. The method of claim 17, wherein the first liquid is hydrocarbon source, a silicon source, or both.

19. The method of claim 17, wherein the first liquid is hexamethyldisilazane, n-heptane, toluene, cyclohexane, propane, n-butane, isobutane, n-hexane, n-octane, n-decane, n-tridecane, benzene, toluene, ethyl benzene, cyclohexane, gasoline, kerosene, lubricating oils, diesel oils, crude oils and mixtures thereof.

20. The method of claim 17, wherein the second liquid is an oxygen source, a hydrogen source, or both.

* * * * *